US006719598B2

(12) United States Patent
Gokan et al.

(10) Patent No.: US 6,719,598 B2
(45) Date of Patent: Apr. 13, 2004

(54) SYSTEM FOR LUBRICATING ENGINE FOR PERSONAL WATERCRAFT

(75) Inventors: Yoshitsugu Gokan, Saitama (JP); Hitoshi Yokotani, Saitama (JP); Michio Izumi, Saitama (JP)

(73) Assignee: Honda Giken Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/191,072

(22) Filed: Jul. 10, 2002

(65) Prior Publication Data

US 2003/0017766 A1 Jan. 23, 2003

(30) Foreign Application Priority Data

Jul. 17, 2001 (JP) ..... 2001-216519

(51) Int. Cl.[7] ..... B63H 21/38

(52) U.S. Cl. ..... 440/88 L; 123/196 R; 123/196 A; 123/198 C

(58) Field of Search ..... 440/88 L, 88; 123/196 R, 196 A, 198 C

(56) References Cited

U.S. PATENT DOCUMENTS 2,754,814 A * 7/1956 Hopwood ..... 123/196 R
4,688,508 A * 8/1987 Nishida ..... 114/362
4,802,871 A * 2/1989 Watanabe et al. ..... 440/75
5,887,564 A * 3/1999 Kawamoto ..... 123/196 R
6,475,046 B2 * 11/2002 Muramatsu et al. ..... 440/88 R
6,484,679 B2 * 11/2002 Ito et al. ..... 123/90.31
6,505,596 B2 * 1/2003 Ito et al. ..... 123/196 R
6,508,224 B2 * 1/2003 Ito et al. ..... 123/196 R
6,537,115 B2 * 3/2003 Suganuma et al. ..... 123/198 C
2003/0017760 A1 * 1/2003 Gokan et al. ..... 440/39
2003/0017765 A1 * 1/2003 Gokan et al. ..... 440/88
2003/0037775 A1 * 2/2003 Gokan ..... 123/572

FOREIGN PATENT DOCUMENTS

JP 2001-140613 A 5/2001

* cited by examiner

*Primary Examiner*—Sherman Basinger
(74) *Attorney, Agent, or Firm*—Birch, Stewart, Kolasch & Birch, LLP

(57) ABSTRACT

To provide a system for lubricating an engine for a personal watercraft, which is capable of simplifying an oil piping structure. An oil pump driven by a crankshaft of an engine and a relief valve for controlling a discharge pressure of the oil pump are provided in an oil tank provided on an extension of the crankshaft of the engine. Suction/discharge passages and the like for the oil pump are provided integrally with a tank main body. An oil filter in communication with the oil pump is provided in an upper portion of the oil tank, and communication passages for the oil filter are provided integrally with the oil tank. The oil filter is aligned with an opening of a deck. The tank main body covers drive chambers for accessories such as an ACG, a balancer shaft, and a starter motor of the engine.

28 Claims, 21 Drawing Sheets

FIG. 12(b)
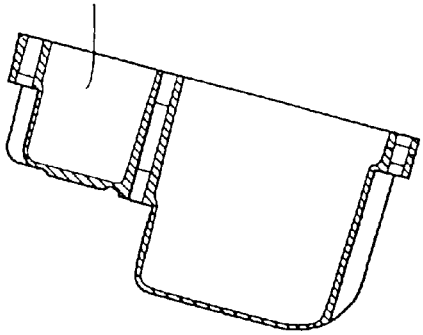
FIG. 12(d)
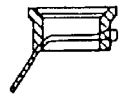
FIG. 12(c)
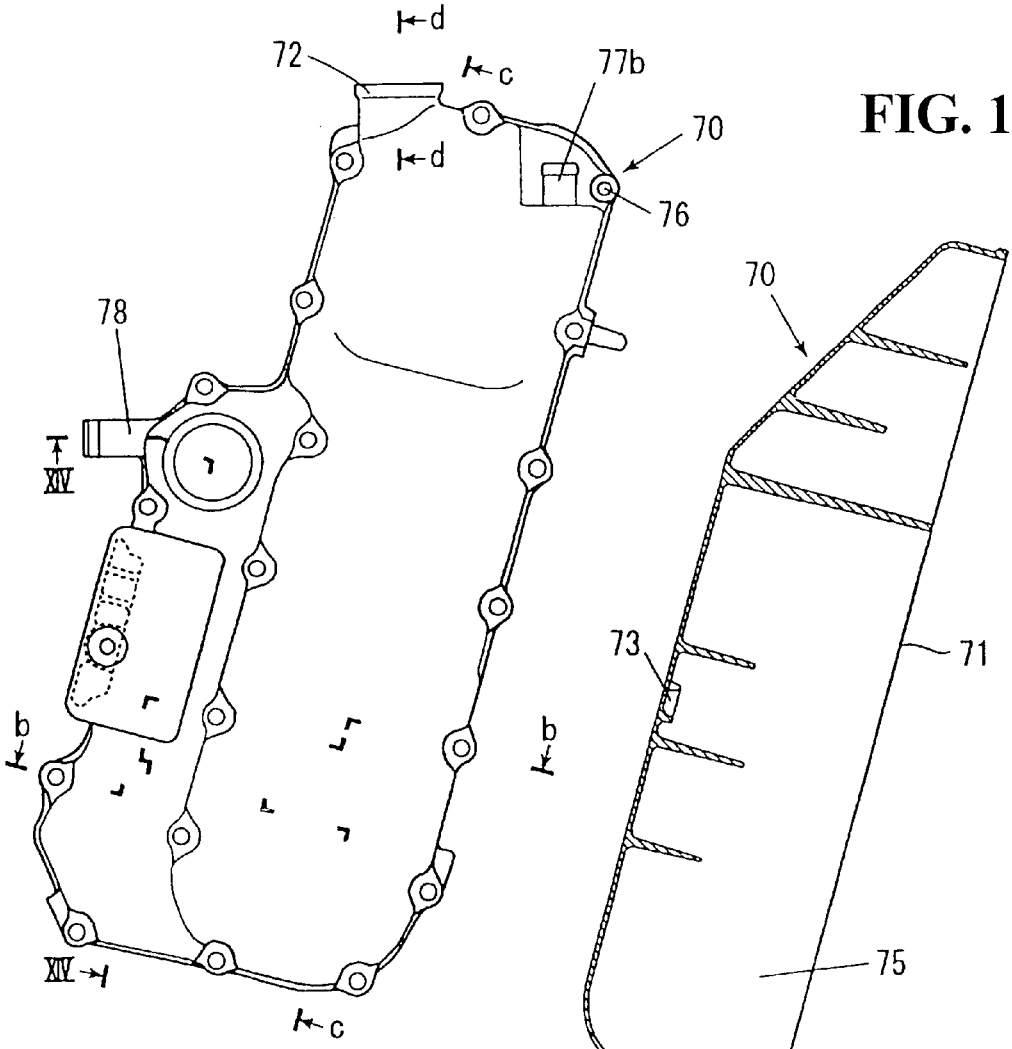
FIG. 12(a)

SYSTEM FOR LUBRICATING ENGINE FOR PERSONAL WATERCRAFT

CROSS-REFERENCE TO RELATED APPLICATIONS

This nonprovisional application claims priority under 35 U.S.C. § 119(*a*) on Patent Application No. 2001-216519 filed in Japan on Jul. 17, 2001, the entirety of which is hereby incorporated by reference.

BACKGROUND OF THE INVENTION

1. Field of the Invention

The present invention relates to a system for lubricating an engine for a personal watercraft.

2. Description of Background Art

Systems for lubricating an engine for a personal watercraft, as shown in FIGS. 20 and 21 of the present invention, have been known, for example, from Japanese Patent Laid-open No. 2001-140613. In this system, an engine 3 for driving a jet propelling pump 2 is provided in a watercraft body 1 surrounded by a hull 1*a* and deck 1*b* in such a manner as to extend in a length direction of the watercraft body 1. An oil pump 4 driven by a crankshaft 3*a* of the engine 3 is provided on an extension of the crankshaft 3*a* of the engine 3. The oil tank 5 is provided over the oil pump 4 and an oil filter 7 is provided on the oil tank 5.

As shown in FIG. 21, the oil pump 4 is connected to an oil pan 3*b* of the engine 3 by way of piping 6*a*. The oil pump 4 is connected to the oil tank 5 by way of piping 6*b* and 6*c*. The oil pump 4 is connected to the oil filter 7 by way of piping 6*d*. Furthermore, the oil filter 7 is connected to a main gallery 3*c* of the engine 3 by way of piping 6*e*.

In FIG. 21, reference numeral 8 denotes a relief valve provided in such a manner as to be in communication with the main gallery 3*c* of the engine 3.

According to the above-described background art system, the oil tank 5 is provided over the oil pump 4. Accordingly, it becomes difficult to lay the oil piping 6*a* to 6*e* in the narrow watercraft body.

SUMMARY OF THE INVENTION

An object of the present invention is to solve the above-described problem, and to provide a system for lubricating an engine for a personal watercraft, which is capable of simplifying an oil piping structure thereof.

To achieve the above object, according to a first aspect of the present invention, a system for lubricating an engine for a personal watercraft includes an engine for driving a jet propelling pump provided in a watercraft body surrounded by a hull and a deck in such a manner as to extend in a length direction of the watercraft body. An oil tank is provided on an extension of a crankshaft of the engine and an oil pump driven by the crankshaft is provided in the oil tank.

According to a second aspect of the present invention, in addition to the configuration of the first aspect of the present invention, a relief valve for controlling a discharge pressure of the oil pump is provided in the oil tank.

According to a third aspect of the present invention, in addition to the configuration of the second aspect of the present invention, the oil tank is composed of a tank main body and a cover. The relief valve is accommodated in the oil tank in such a manner as to be in communication with a discharge passage of the oil pump and is brought into contact with the cover.

According to a fourth aspect of the present invention, in addition to the configuration of the third aspect of the present invention, the tank main body and the cover are joined to each other with their contact planes extending substantially in the vertical direction. The relief valve is accommodated in the oil tank in such a manner as to extend in the horizontal direction.

According to a fifth aspect of the present invention, in addition to the configuration of the third and fourth aspects of the present invention, the oil pump is accommodated in a portion, on the tank main body side, of the oil tank. Suction/discharge passages of the oil pump are formed integrally with the tank main body.

According to a sixth aspect of the present invention, in addition to the configuration of the third through fifth aspects of the present invention, the tank main body covers drive chambers for accessories such as an AC generator, a balancer shaft, and a starter motor of the engine.

According to a seventh aspect of the present invention, in addition to the configuration of the first through sixth aspects of the present invention, an oil filter in communication with the oil pump of the oil tank is provided in an upper portion of the oil tank. A communication passage for communicating the oil tank to the oil filter is formed integrally with the oil tank.

According to an eighth aspect of the present invention, in addition to the configuration of the seventh aspect of the present invention, the engine and the oil filter are aligned with an opening of the deck.

According to a ninth aspect of the present invention, in addition to the configuration of seventh and eighth aspects of the present invention, a mounting portion for mounting the oil filter is provided on an upper portion of the oil tank. An oil receiving portion is formed in the mounting portion and is in communication with the communication passage.

According to the system for lubricating an engine for a personal watercraft according to the first aspect of the present invention, the engine for driving a jet propelling pump is provided in the watercraft body surrounded by the hull and the deck in such a manner as to extend in the length direction of the watercraft body. The oil tank is provided on an extension of the crankshaft of the engine. In addition, the oil pump is driven by the crankshaft and is provided in the oil tank. Accordingly, it is possible to simplify the oil piping structure. Specifically, at least the piping (6*b* and 6*c*) in the background art for connecting the oil pump to the oil tank can be omitted.

According to the system for lubricating an engine for a personal watercraft according to the second aspect of the present invention, the relief valve for controlling a discharge pressure of the oil pump is provided in the oil tank. Accordingly, it is possible to discharge relief oil from the relief valve 130 in the oil tank 50. In addition, it is possible to reduce the volume of the oil pump as compared with a configuration where relief oil is discharged in the engine (for example, in the oil pan (3*b*) as in the above-described background art).

According to the system for lubricating an engine for a personal watercraft according to the third aspect of the present invention, the oil tank is composed of the oil main body and the cover. The relief valve is accommodated in the oil tank in such a manner as to be in communication with the discharge passage of the oil pump and is brought into contact with the cover. Accordingly, it is possible to simplify the accommodation and fixture of the relief valve.

According to the system for lubricating an engine for a personal watercraft according to the fourth aspect of the present invention, the tank main body and the cover are joined to each other with their contact planes extending substantially in the vertical direction. The relief valve is accommodated in the oil tank in such a manner as to extend in the horizontal direction. Accordingly, it is possible to easily assemble the relief valve.

According to the system for lubricating an engine for a personal watercraft according to a fifth aspect of the present invention, the oil pump is accommodated in a portion, on the tank main body side, of the oil tank and the suction/discharge passages of the oil pump are formed integrally with the tank main body. Accordingly, it is possible to further simplify the oil piping structure.

According to the system for lubricating an engine for a personal watercraft according to the sixth aspect of the present invention, the tank main body covers drive chambers for accessories such as the ACG the balancer shaft, and the starter motor of the engine. Accordingly, it is possible to eliminate the need for covers specialized for covering the drive chambers for the accessories. Therefore, the engine can be made more compact.

According to the system for lubricating an engine for a personal watercraft according to the seventh aspect of the present invention, the oil filter in communication with the oil pump in the oil tank is provided in the upper portion of the oil tank. Passages for communicating the oil tank to the oil filter are formed integrally with the oil tank. Accordingly, it is possible to further simplify the oil piping structure.

According to the system for lubricating an engine for a personal watercraft according to the eighth aspect of the present invention, the oil filter is aligned with the opening of the deck. Accordingly, it is possible to easily perform the necessary work to change the oil filter.

According to the system for lubricating an engine for a personal watercraft according to the ninth aspect of the present invention, the mounting portion for mounting the oil filter is provided on an upper portion of the oil tank. Furthermore, the oil receiving portion is formed in the mounting portion and is in communication with the communication passage. As a result, oil, which may be dropped at the time of mounting/dismounting the oil filter to or from the mounting portion, is received in the oil receiving portion and is then returned into the oil tank. Accordingly, the inside of the watercraft body will be less contaminated with oil.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 12(*a*) to 12(*d*) are views showing the cover 70, wherein FIG. 12(*a*) is a front view, FIG. 12(*b*) is a sectional view taken on line b—b of FIG. 12(*a*), FIG. 12 (*c*) a sectional view taken on line c—c of FIG. 12(*a*), and FIG. 12(*d*) is a sectional view taken on line d—d of FIG. 12(*a*);

DETAILED DESCRIPTION OF THE PREFERRED EMBODIMENTS

Hereinafter, an embodiment of the present invention will be described with reference to the accompanying drawings.

Figure 1:
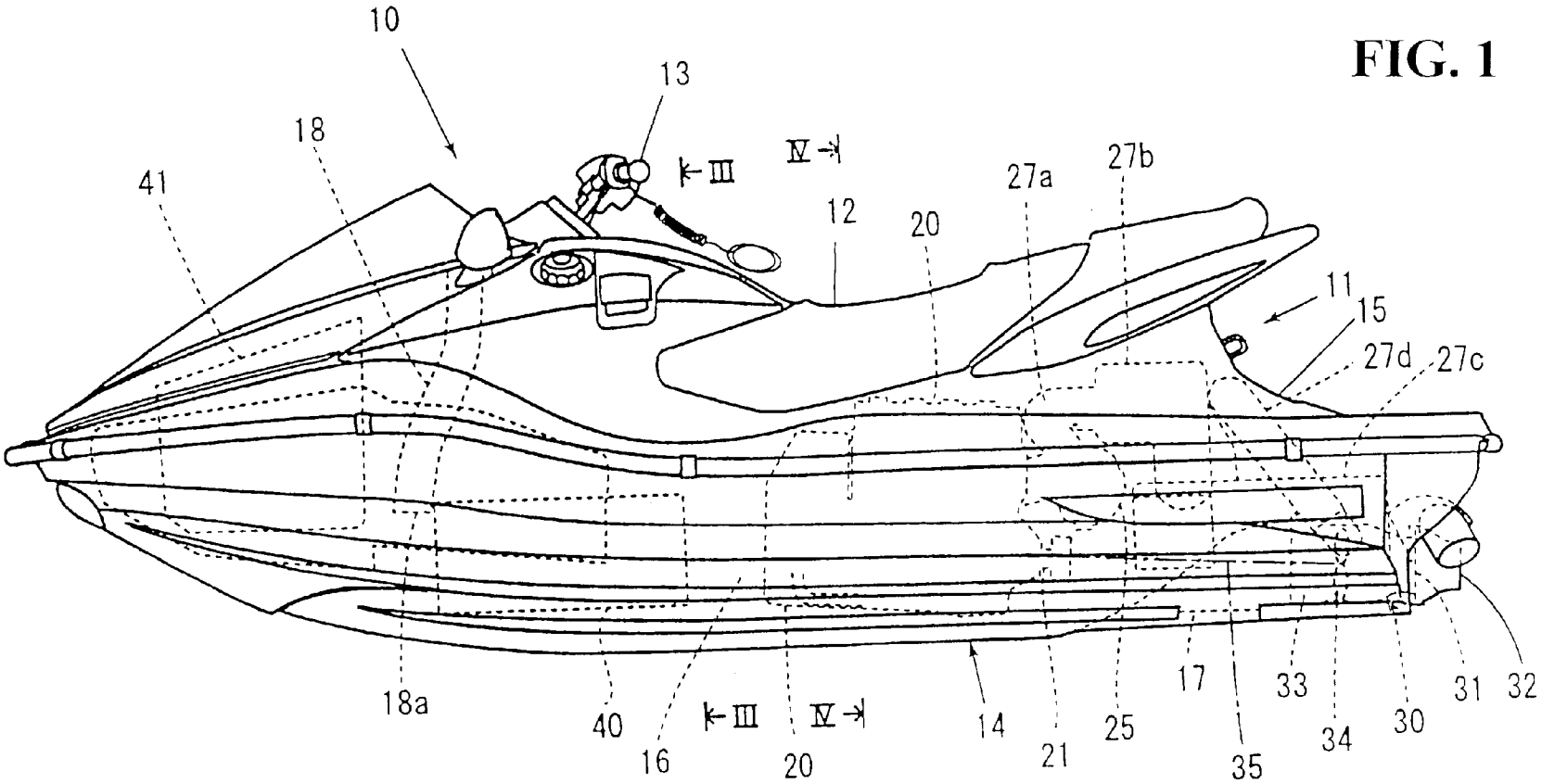
FIG. 1 is a schematic side view showing one example of a personal watercraft using one embodiment of an oil tank system for an engine according to the present invention.
Figure 2:
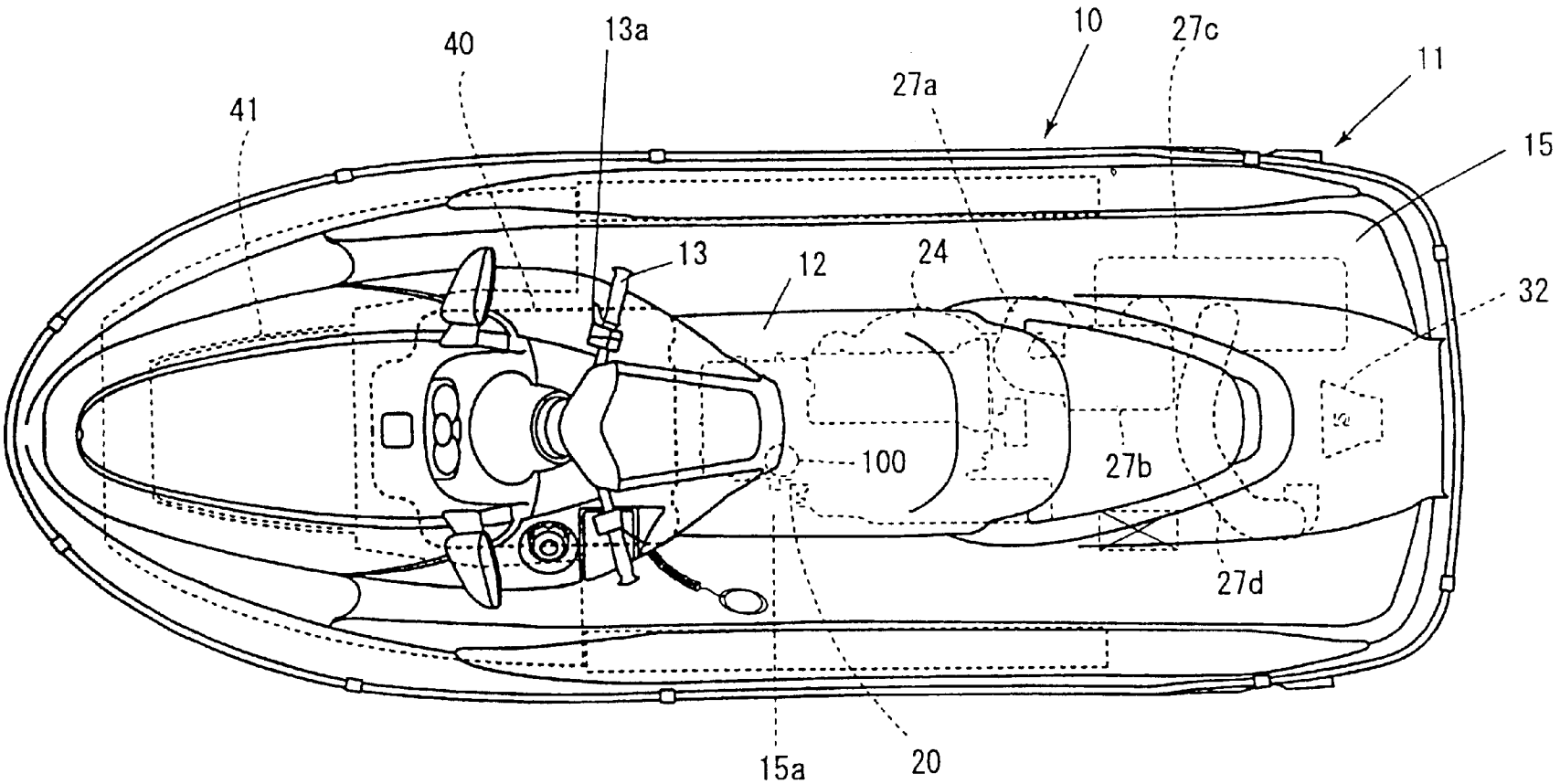
FIG. 2 is a plan view of the personal watercraft shown in FIG. 1.
Figure 3:
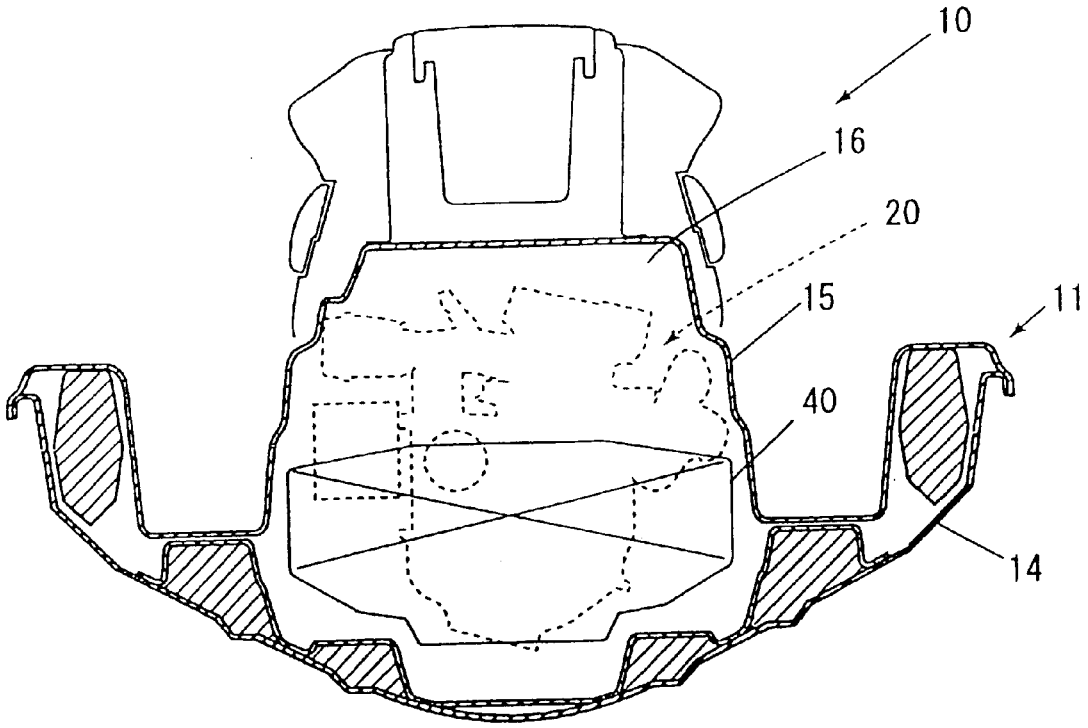
FIG. 3 is a partial, enlarged sectional view taken on line III—III of FIG. 1 (with parts partially omitted)

FIG. 1 is a schematic side view showing one example of a personal watercraft to which one embodiment of a system for lubricating an engine for a personal watercraft according to the present invention is applied. FIG. 2 is a plan view of the personal watercraft. FIG. 3 is a partial, enlarged sectional view taken on line III—III of FIG. 1 (with parts partially omitted).

Referring to the above figures (particularly, to FIG. 1), a personal watercraft 10 is a saddle type small watercraft, which is operable by a driver who sits on a seat 12 provided on a watercraft body 11 and holds a steering handlebar 13 provided with a throttle lever.

The watercraft body 11 has a floating structure. A hull 14 is joined to a deck 15 so as to form a space 16 therein. In the space 16, an engine 20 is mounted on the hull 14. A jet pump or jet propelling pump 30 is driven by the engine 20 and is provided on a rear portion of the hull 14.

The jet pump 30 has a flow passage 33 extending from a water inlet 17 opened in a bottom of the hull 14 to both a jet port 31 opened in a rear end portion of the hull 14 and a nozzle 32. An impeller 34 is disposed in the flow passage 33. A shaft 35 of the impeller 34 is connected to an output shaft 21 of the engine 20. When the impeller 34 is rotated by the engine 20, water taken in via the water inlet 17 is jetted from the jet port 31 via the nozzle 32, to propel the watercraft body 11. A rotational speed of the engine 20, that is, a propelling force of the jet pump 30 is controlled by turning a throttle lever 13*a* (see FIG. 2) of the steering handlebar 13. The nozzle 32 is coupled to the steering handlebar 13 via a steering wire (not shown), and is turned by operation of the steering handlebar 13, to change a direction of travel of the personal watercraft 10.

In the figures, reference numeral 40 denotes a fuel tank, and reference numeral 41 denotes a storing or storage chamber.

Figure 4:
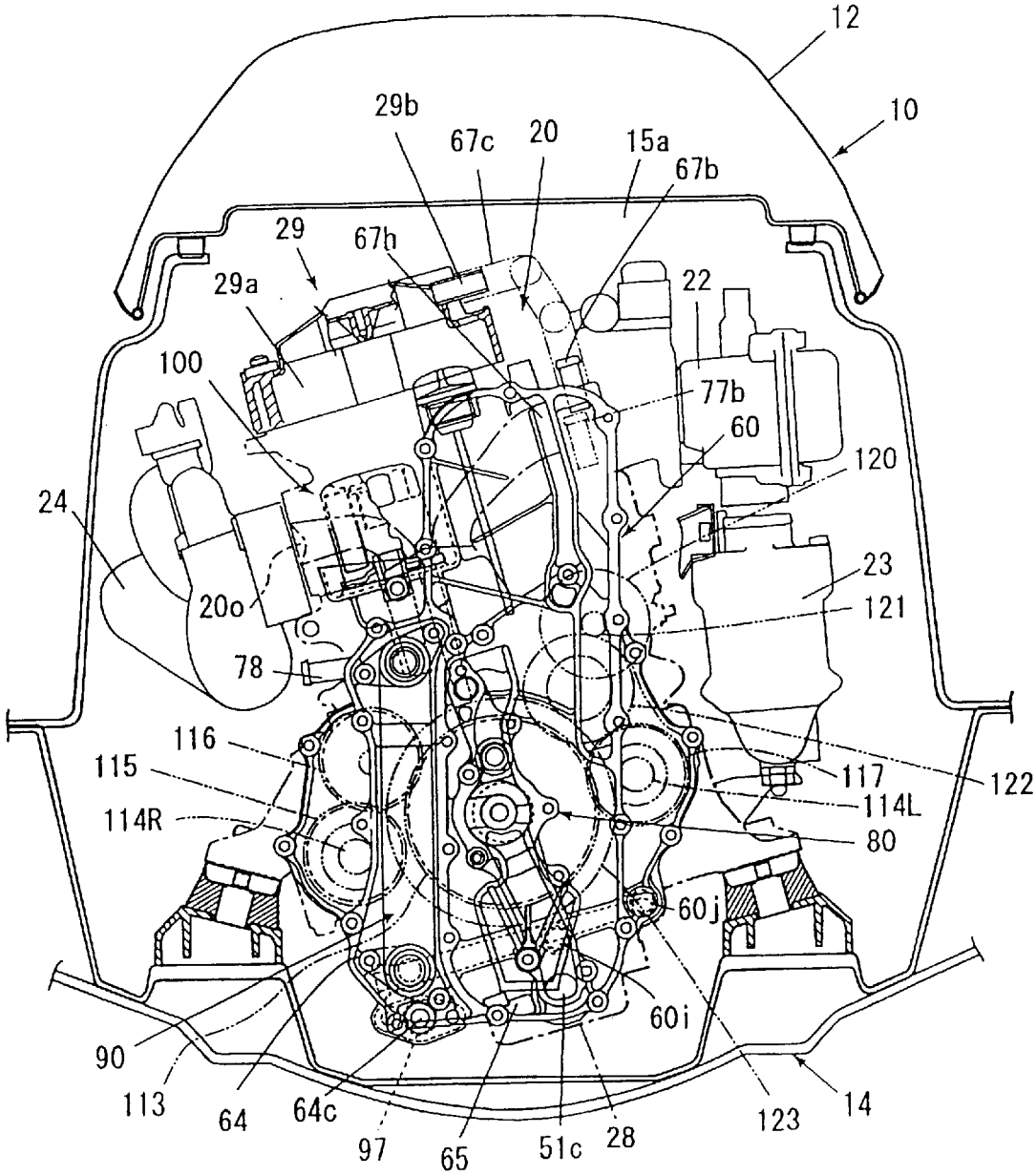
FIG. 4 is a partial, enlarged sectional view taken on line IV—IV of FIG. 1, mainly showing the engine 20.
Figure 5:
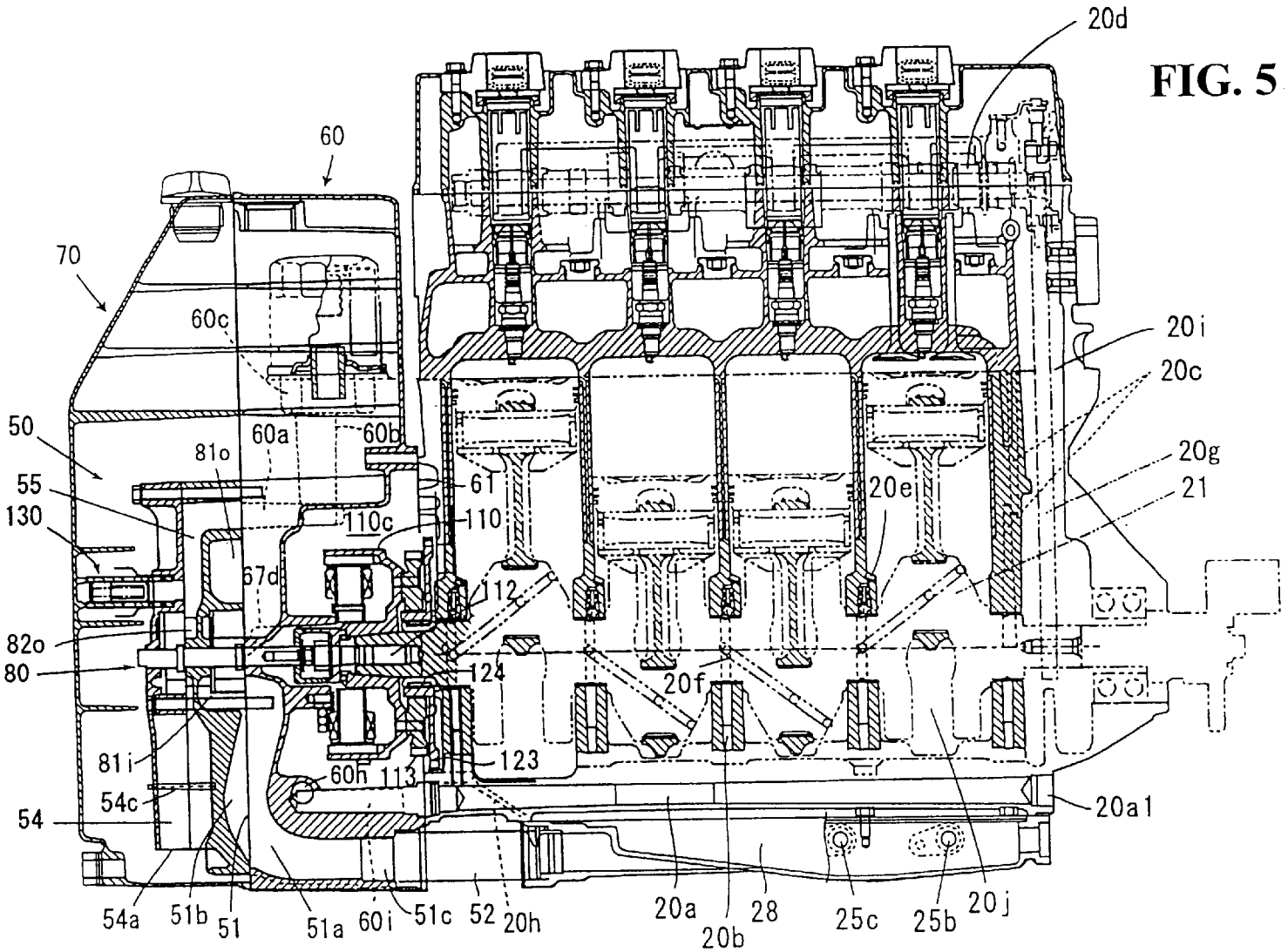
FIG. 5 is a right side view of the engine 20.
Figure 6:
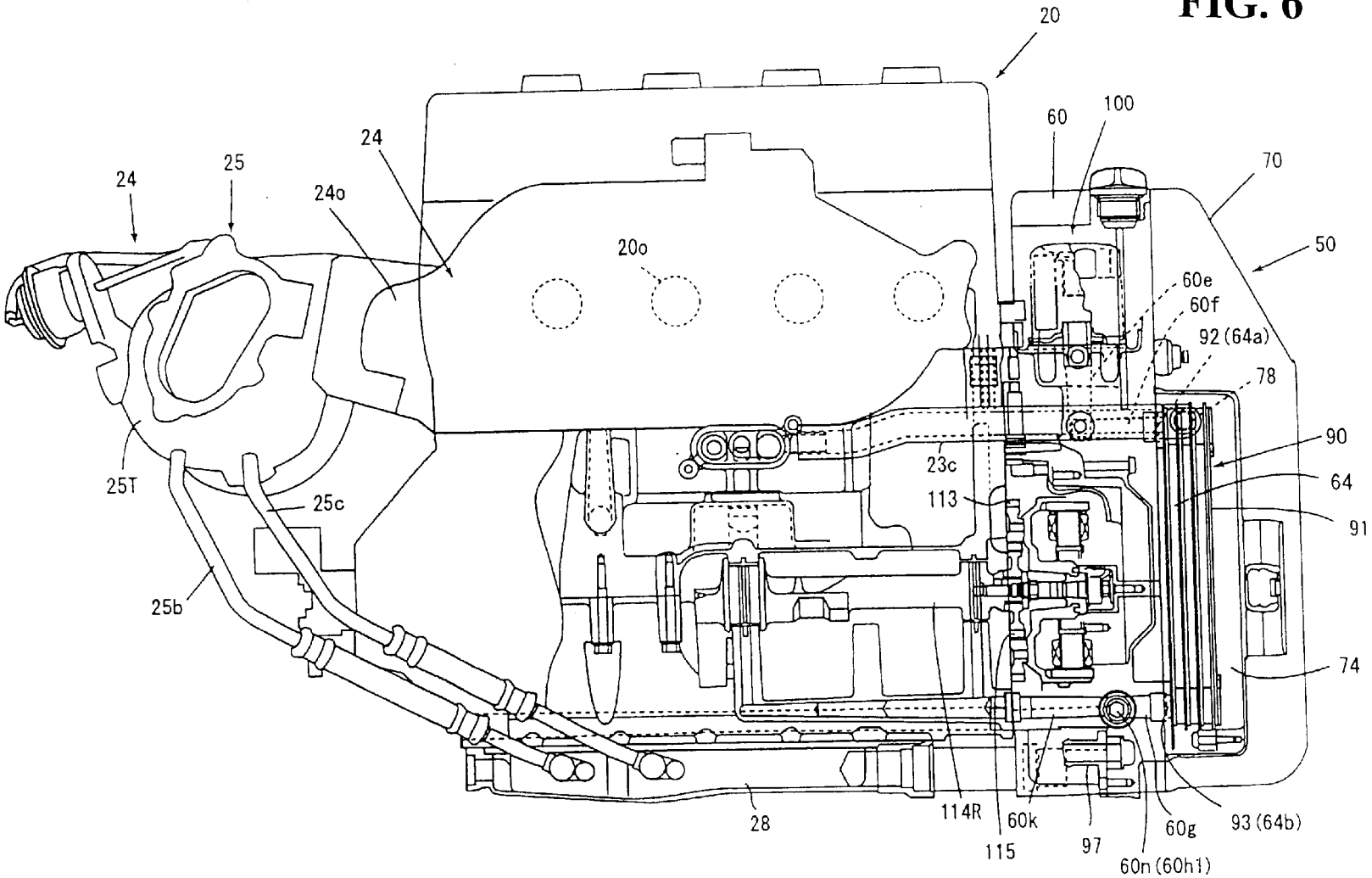
FIG. 6 is a left side view of the engine 20.
Figure 7:
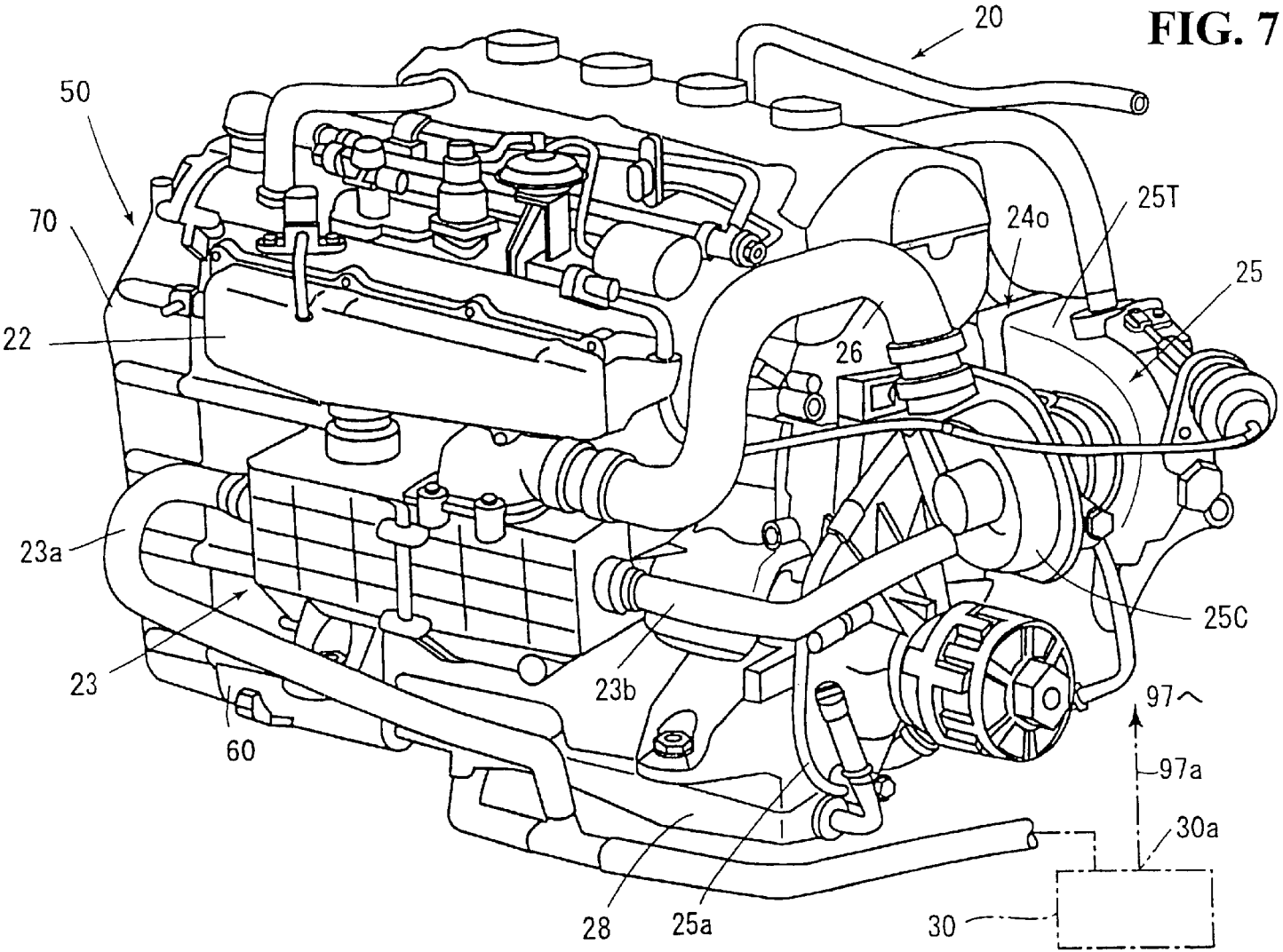
FIG. 7 is a schematic perspective view of the engine 20 as seen from an obliquely rear direction.
Figure 8:
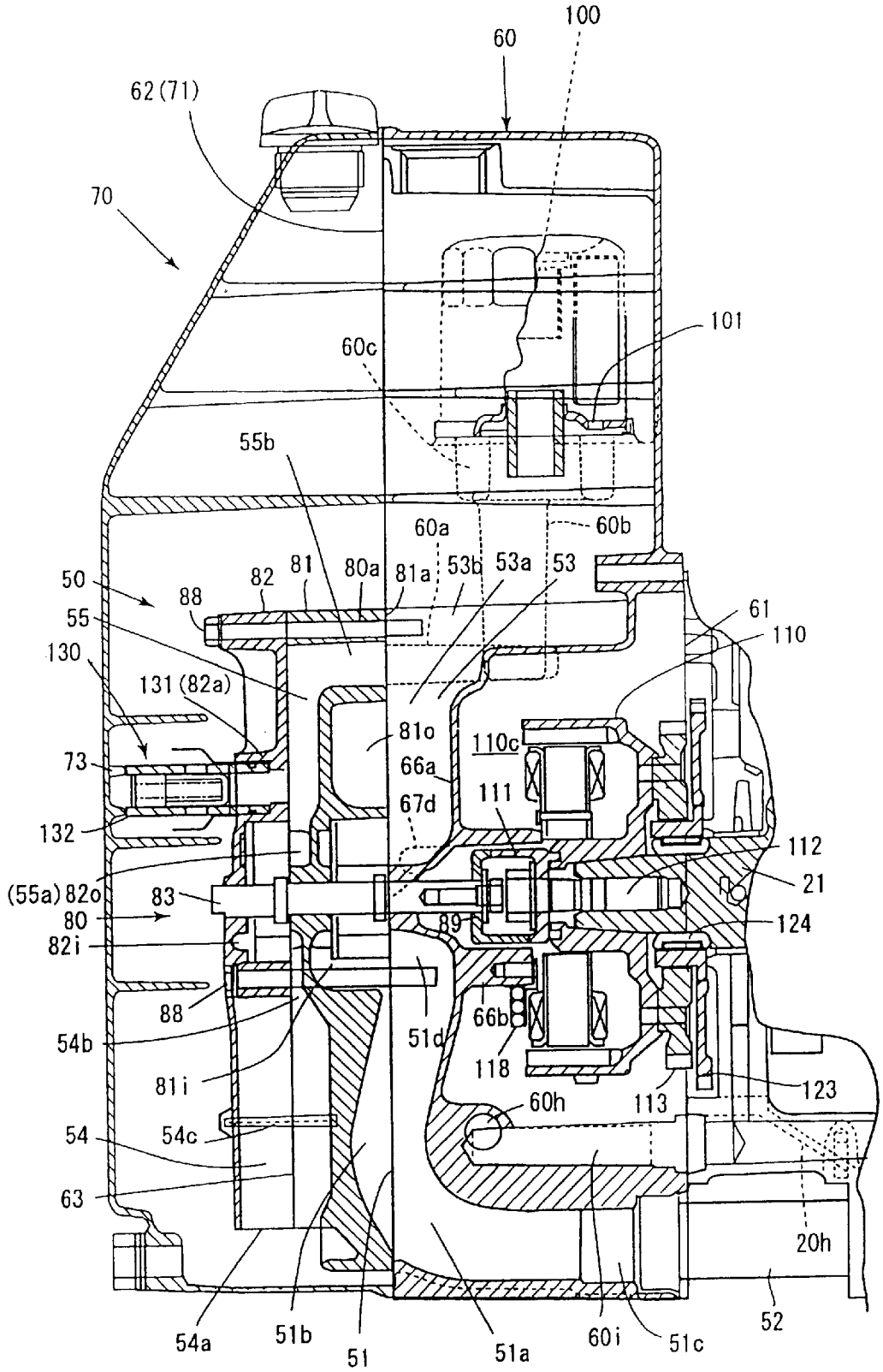
FIG. 8 is an enlarged view of a portion shown in FIG. 5.
Figure 9A:
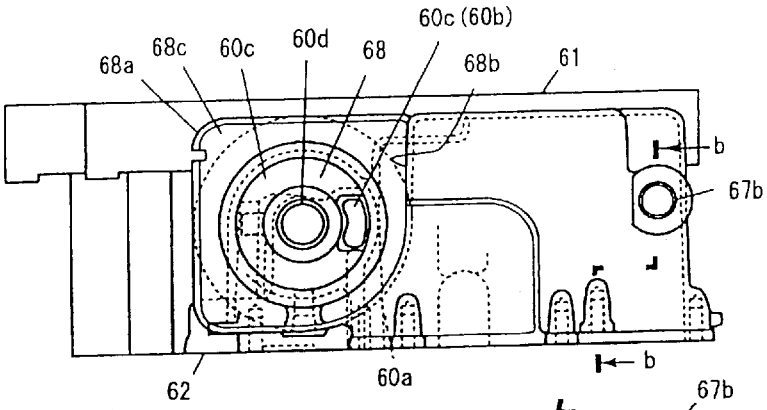
FIGS. 9(*a*) to 9(*d*) are views showing the tank main body 60, wherein FIG. 9(*a*) is a plan view, FIG. 9(*b*) is a front view, FIG. 9(*c*) is a sectional view taken on line c—c of FIG. 9(*b*), and FIG. 9(*d*) is a sectional view taken on line b—b of FIG. 9(*a*)
Figure 9D:
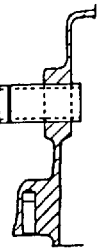
Figure 9B:
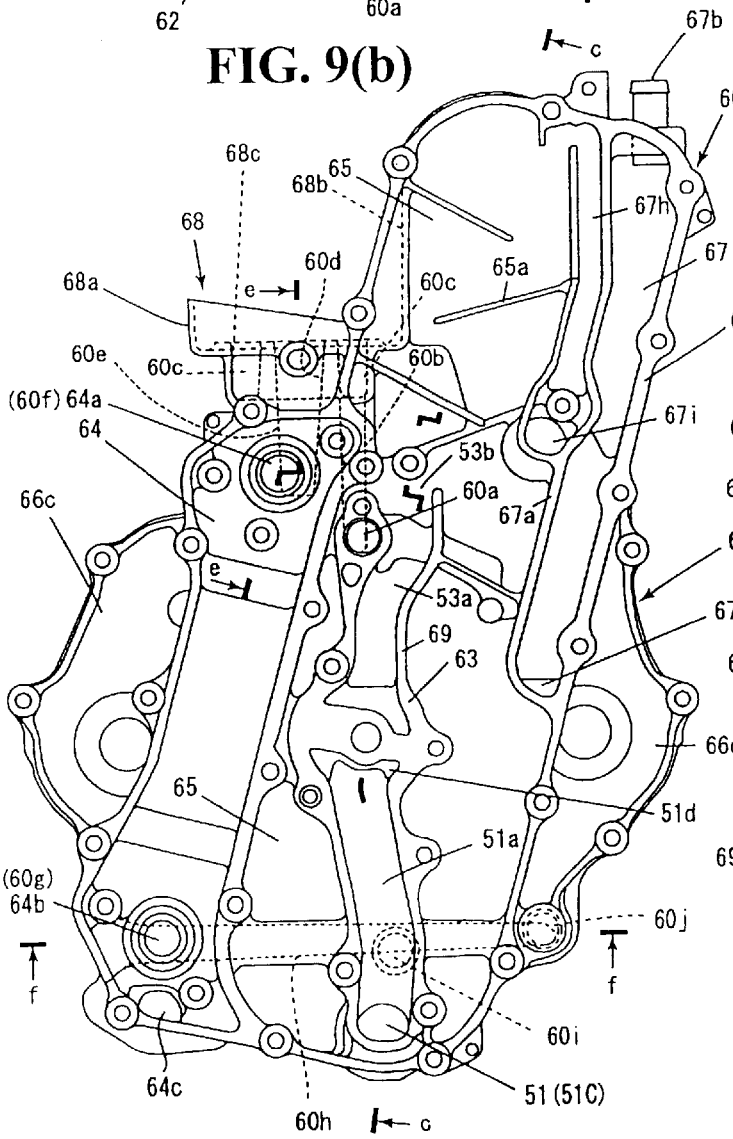
Figure 9C:
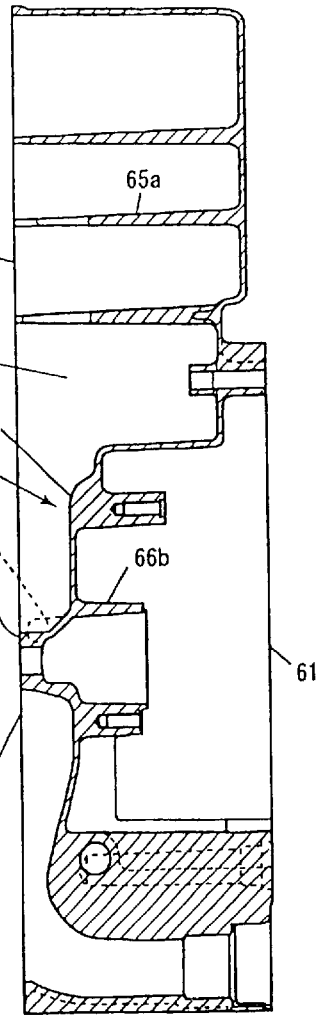

FIG. 4 is a view mainly showing the engine 20, which is a partial, enlarged sectional view taken on line IV—IV of FIG. 1 (with parts partially omitted). FIG. 5 is a right side view of the engine 20. FIG. 6 is a left side view of the engine 20. FIG. 7 is a schematic perspective view of the engine 20 as seen from an obliquely rearward direction. FIG. 8 is an enlarged view of a portion shown in FIG. 5.

The engine 20 is a DOHC type in-line four-cylinder/four-cycle engine, which is a dry sump type according to this embodiment. As shown in FIGS. 1 and 5, a crankshaft 21 of the engine 20 extends along the longitudinal direction of the watercraft body 11.

As shown in FIGS. 4 and 7, a surge tank (intake chamber) 22 is in communication with an intake port and an inter-cooler 23 is connected to the surge tank 22. The surge tank 22 and the inter-cooler 23 are disposed on the left side of the engine 20 as seen in the running direction of the watercraft body 11. An exhaust manifold 24 (see FIG. 6), which is connected and in communication with exhaust ports 20*o*, is disposed on the right side of the engine 20.

As shown in FIGS. 6 and 7, a turbo-charger 25 is disposed at the back of the engine 20. An exhaust outlet 24*o* of the exhaust manifold 24 is connected to a turbine portion 25T of the turbo-charger 25. The inter-cooler 23 is connected to a compressor portion 25C of the turbo-charger 25 via piping 26 (see FIG. 7). In FIG. 7, reference numerals 23*a* and 23*b* denote cooling hoses connected to the inter-cooler 23.

As shown in FIGS. 1 and 2, exhaust gas which has rotated a turbine in the turbine portion 25T of the turbo-charger 25 passes piping 27*a*, a counter-flow preventing chamber 27*b*, a water muffler 27*c*, and an exhaust/drainage pipe 27*d*, and flows in a water stream caused by the jet pump 30. The counter flow preventing chamber 27*b* is for preventing counter-flow upon turn-over of the watercraft body 11 (permeation of water in the turbo-charger 25 and the like).

As shown in FIGS. 4 to 8, an oil tank 50 and an oil pump 80 are located in a front portion of the engine 20 as seen in the running direction of the watercraft body 11 (equivalent to a left portion in FIGS. 1 and 5). The oil pump 80 is integrated with the oil tank 50. Furthermore, the oil tank 50 and the oil pump 80 are provided on an extension of the crankshaft 21. The oil pump 80 is provided in the oil tank 50.

The oil tank 50 includes a tank main body (one divided case) 60 joined to a front plane of the engine 20. A cover (the other divided case) 70 is joined to a front plane of the tank main body 60.

Figure 10:
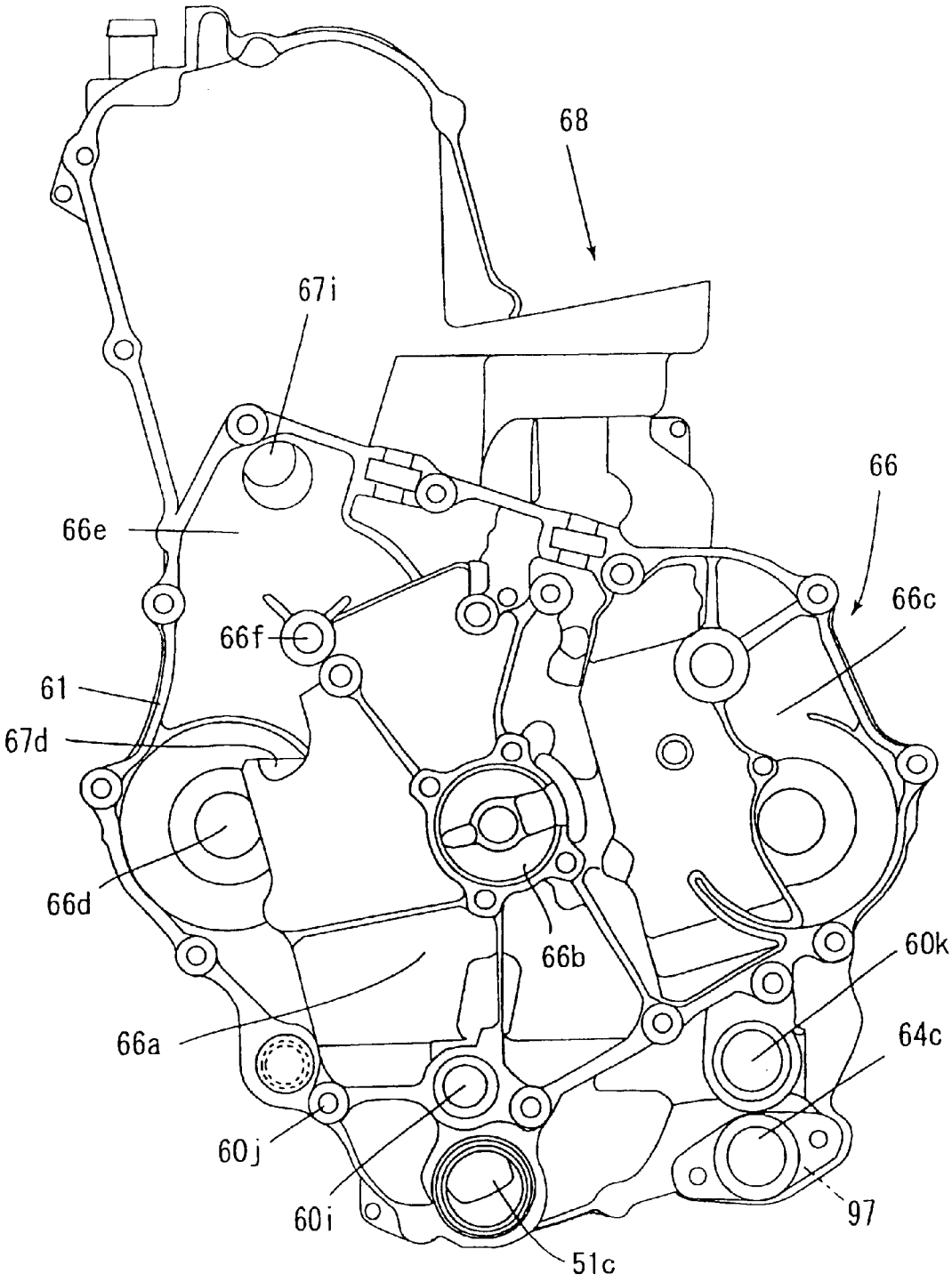
FIG. 10 is a back view of the tank main body 60.
Figure 11A:
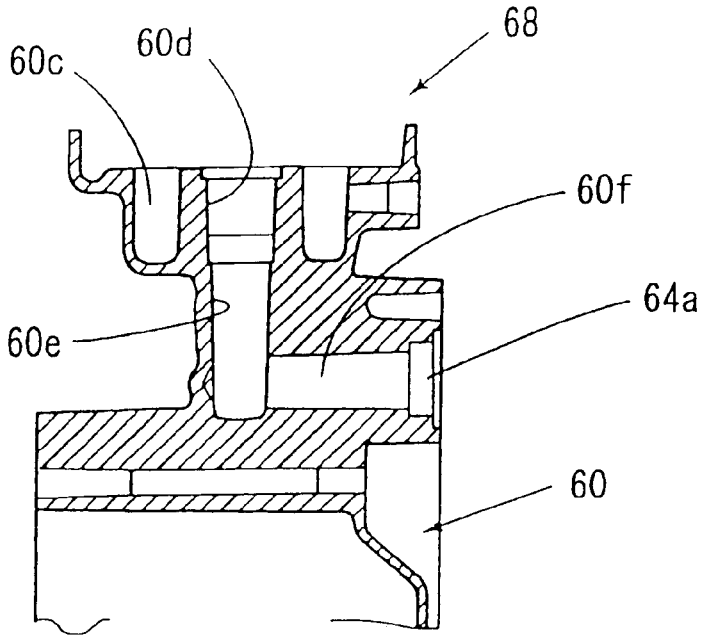
FIG. 11(*a*) is a sectional view taken on line e—e of FIG. 9(*b*) and FIG. 11(*b*) is a sectional view taken on line f—f of FIG. 9(*b*)
Figure 11B:
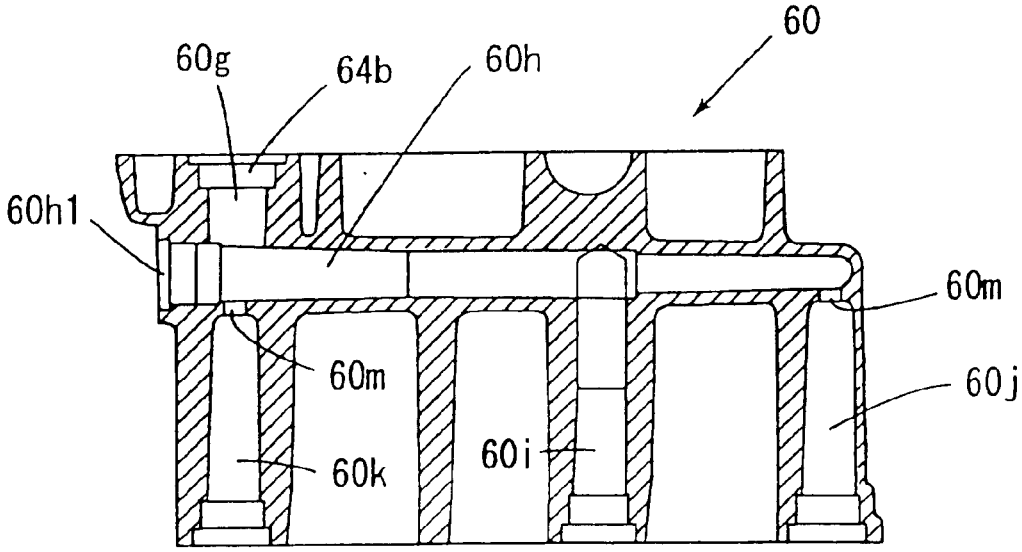

FIGS. 9(*a*) to 9(*d*) are views showing the tank main body 60. FIG. 9(*a*) is a plan view. FIG. 9(*b*) is a front view. FIG. 9(*c*) is a sectional view taken on line c—c of FIG. 9(*b*). FIG. 9(*d*) is a sectional view taken on line b—b of FIG. 9(*a*). FIG. 10 is a back view of the tank main body 60. FIG. 11(*a*) is a sectional view taken on line e—e of FIG. 9(*b*). FIG. 11(*b*) is a sectional view taken on line f—f of FIG. 9(*b*).

Figure 13B:
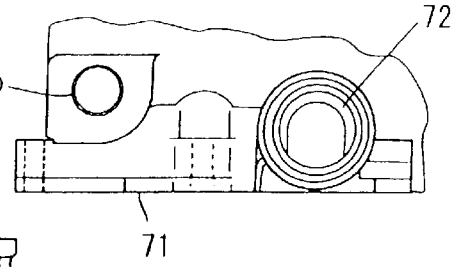
FIGS. 13(*a*) to 13(*c*) are views showing the cover 70, wherein FIG. 13(*a*) is a back view, FIG. 13(*b*) is a view seen along a direction shown by an arrow "b" in FIG. 13(*a*), and FIG. 13(*c*) is a sectional view taken on line c—c of FIG. 13(*a*)
Figure 13A:
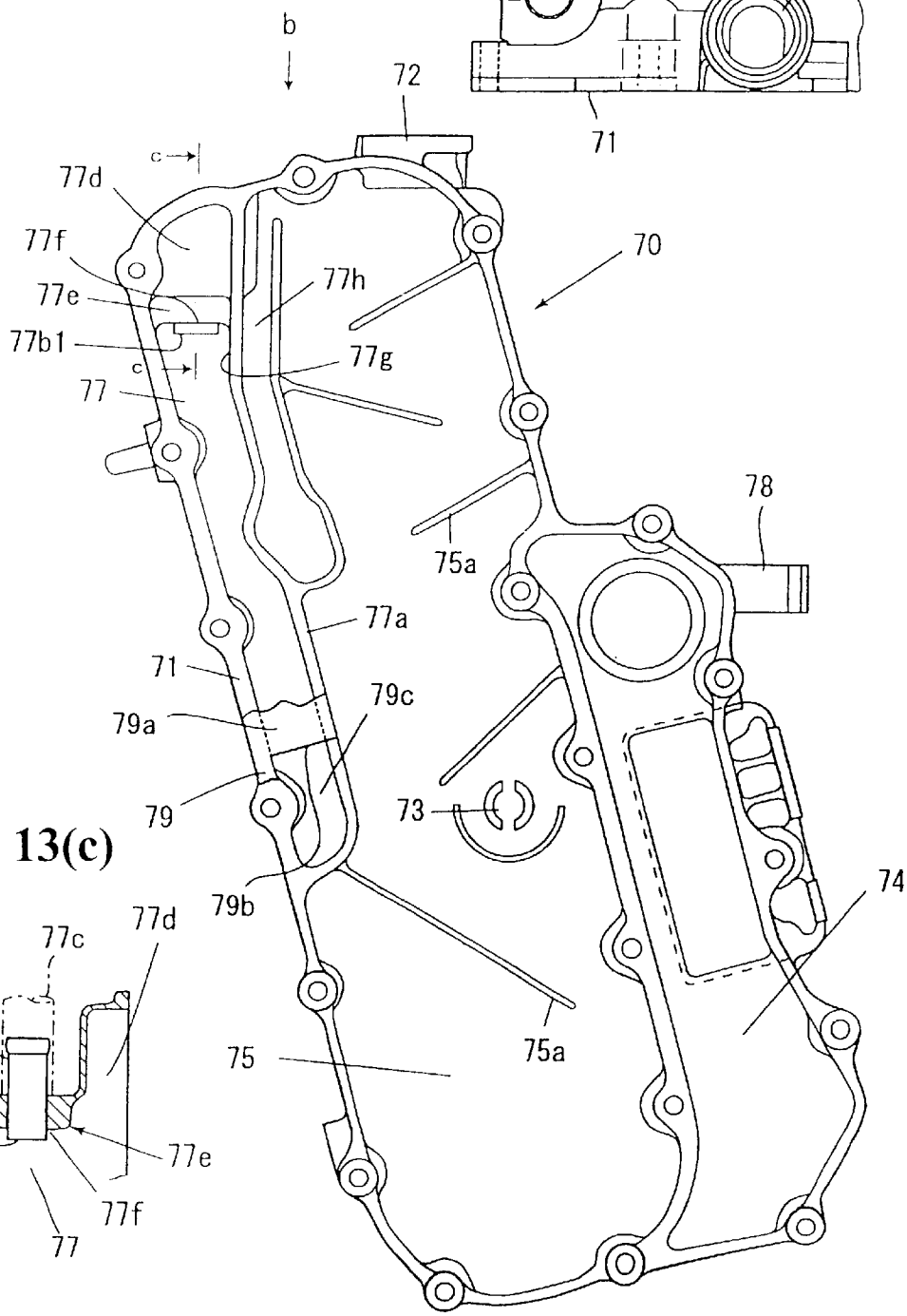
Figure 13C:
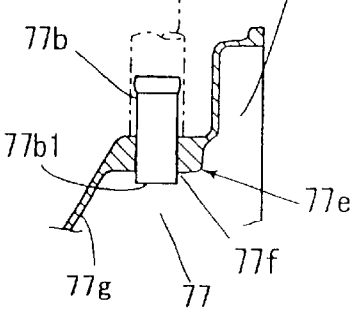
Figure 14:
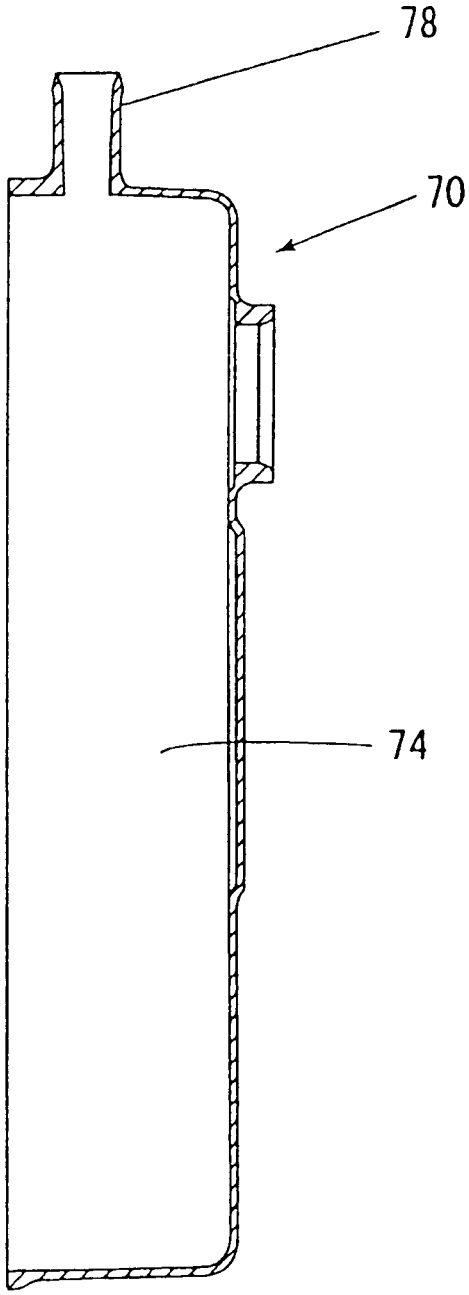
FIG. 14 is a sectional view taken on line XIV—XIV of FIG. 12(*a*)
Figure 15:
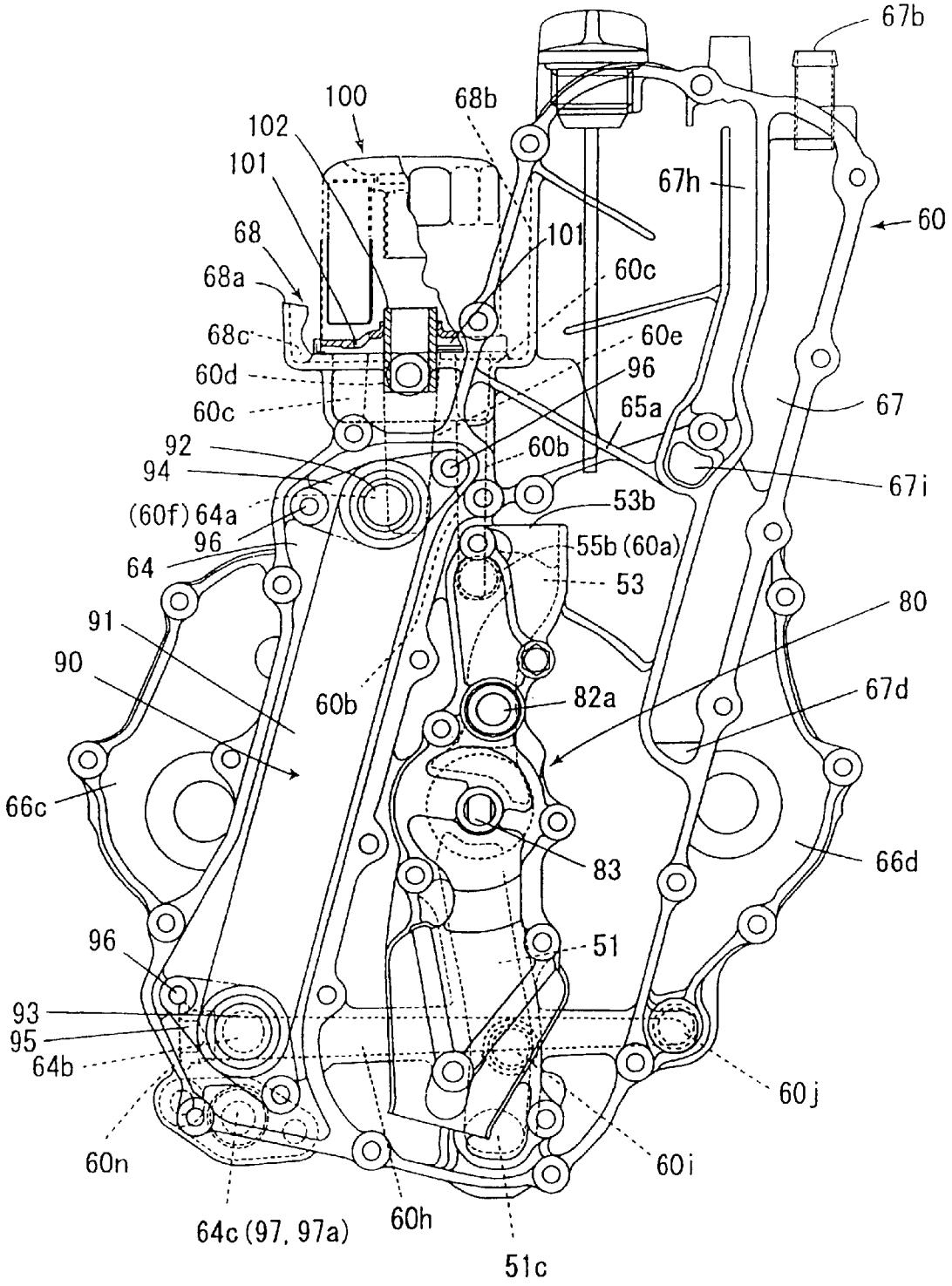
FIG. 15 is an enlarged view of a portion shown in FIG. 4.

FIGS. 12(*a*) to 12(*d*) are views showing the cover 70. FIG. 12(*a*) is a front view. FIG. 12(*b*) is a sectional view taken on line b—b of FIG. 12(*a*). FIG. 12(*c*) is a sectional view taken on line c—c of FIG. 12(*a*). FIG. 12(*d*) is a sectional view taken on line d—d of FIG. 12(*a*). FIGS. 13(*a*) to 13(*c*) are views showing the cover 70. FIG. 13(*a*) is a back view. FIG. 13(*b*) is a view seen in the direction shown by an arrow "b" in FIG. 13(*a*). FIG. 13(*c*) is a sectional view taken on line c—c of FIG. 13(*a*). FIG. 14 is a sectional view taken on line XIV—XIV of FIG. 12(*a*); and FIG. 15 is an enlarged view of a portion shown in FIG. 4.

Referring to FIGS. 9(*a*)–(*d*) and 10, the tank main body 60 includes a contact plane 61 joined to the front plane of the engine 20. A contact plane 62 is joined to the cover 70. A mounting plane 63 includes the oil pump 80 mounted thereon. A mounting portion 64 includes a water-cooled type oil cooler 90 (to be described below) mounted thereon. An oil storing or storage portion 65 is defined by partition walls forming the mounting planes and the like and outer walls. The storage portion 65 is formed into a vertically-elongated shape as a whole. A cover portion 66 is provided for covering drive chambers for an ACG (to be described below), a balancer shaft, and a starter motor. The tank main body 60 also includes a first sub-breather chamber 67 (to be described below) and a mounting portion 68 on which an oil filter 100 (to be described below) is mounted. A plurality of baffle plates 65*a* are formed in the oil storage portion 65.

Referring to FIGS. 5 and 8 (particularly to FIG. 8), reference numeral 110 denotes an ACG rotor, which is fixed, together with a coupling 111, to a leading end of the crankshaft 21 by a bolt 112. The coupling 111 is coupled to a coupling 89 fixed to a rear end of a pump shaft (to be described below).

Referring to FIGS. 4, 5 and 8, reference numeral 113 denotes a balancer driving gear. The balancer driving gear 113 is fixed to a back surface of the ACG rotor 110. As shown in FIG. 4, the gear 113 is meshed, via an idle gear 116, with a balancer gear 115. The balancer gear 115 is fixed to a leading end of a balancer 114R (see FIG. 6). The balancer 114R is disposed in parallel to the crankshaft 21 on the right side in the engine 20 (left side in FIG. 4). Accordingly, the gear 113 can rotate the balancer 114R. The gear 113 is also directly meshed with a gear 117. The gear 117 is fixed on a leading end of a balancer 114L. The balancer 114L is disposed in parallel to the crankshaft 21 on the left side in the engine 20 (right side in FIG. 4). Accordingly, the gear 113 can rotate the balancer 114L in a reverse direction to the rotating direction of the balancer 114R.

In FIG. 4, reference numeral 120 denotes a starter motor, which is provided with a pinion gear 121 meshed with a starter gear 123 via a reduction gear 122. The starter gear 123 is connected to the crankshaft 21 via a one-way clutch 124 (see FIG. 8).

Referring to FIGS. 8, 9 and 10, the cover portion 66 of the tank main body 60 has an ACG cover portion 66*a* for covering the ACG rotor 110, the balancer driving gear 113, and a starter gear 123. In addition, a coupling cover portion 66*b* is provided for covering the coupling 111 portion. A right balancer driving system cover portion 66*c* is provided for covering the balancer gear 115 and the idle gear 116. A left balancer driving system cover portion 66*d* is provided for covering the balancer gear 117. Furthermore, a starter driving system cover portion 66*e* is provided for covering the pinion gear 121 of the starter motor 120 and the reduction gear 122. In these figures, reference numeral 66*f* denotes a hole for supporting a shaft of the reduction gear 122.

In FIG. 8, reference numeral 118 denotes a pulser, provided on an outer periphery of the ACG, for taking out a pulse signal. In the ACG cover portion 66*a*, the pulser 118 is mounted on the coupling cover portion 66*b*. Accordingly, the pulser 118 overlaps with the oil tank 50 in the axial direction of the crank shaft 21.

The tank main body 60 configured as described above is joined to the front plane of the engine 20 at its contact plane 61 in a state where the above-described portions of the tank main body 60 are covered with the cover portion 66. The tank main body is integrally fixed to the front plane of the engine 20 with bolts (not shown). It should be noted that after the oil pump 80 and the oil cooler 90 (to be described below) are mounted to the tank main body 60, the tank main body 60 is mounted to the front plane of the engine 20.

Referring to FIGS. 12 to 14, the cover 70 includes a contact plane 71 joined to the tank main body 60, an oil supply port 72, and a pressing portion 73. The pressing portion 73 is for pressing a relief valve (to be described below). An oil cooler accommodating portion 74 is provided for accommodating the oil cooler (to be described below). An oil storing or storage portion 75 is defined by the outer wall and the partition walls. The second sub-breather chamber 77 will be fully described below. A plurality of baffle plates 75*a* are formed in the oil storage portion 75.

Figure 16A:
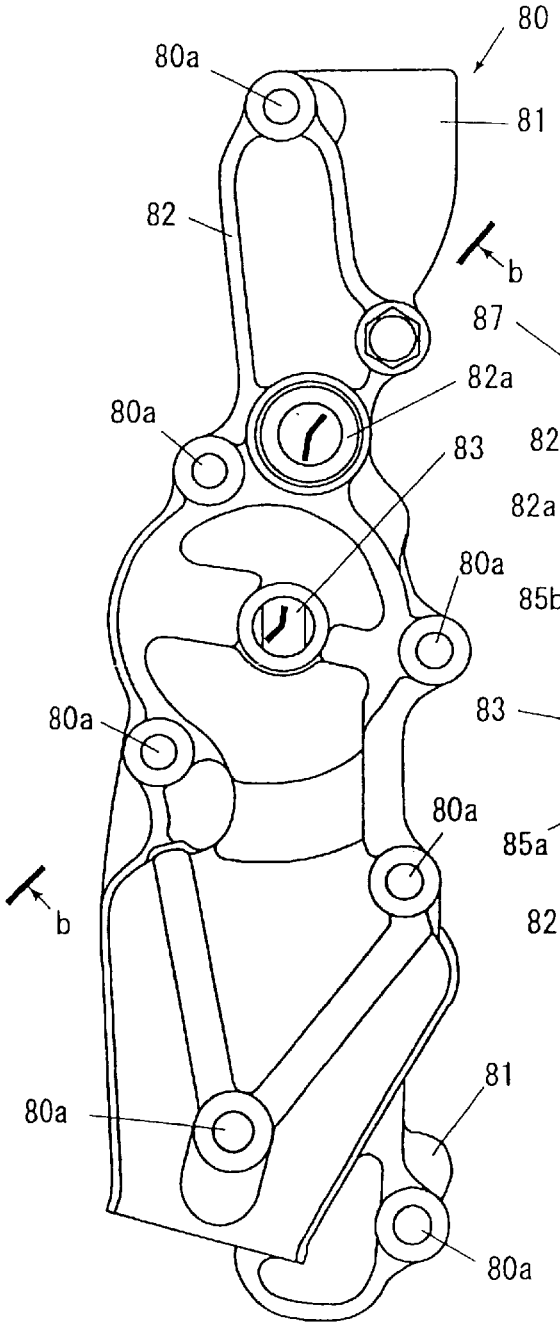
FIGS. 16(*a*) and 16(*b*) are views showing an oil pump 80, wherein FIG. 16(*a*) is a front view and FIG. 16(*b*) is a sectional view taken on line b—b of FIG. 16(*a*)
Figure 16B:
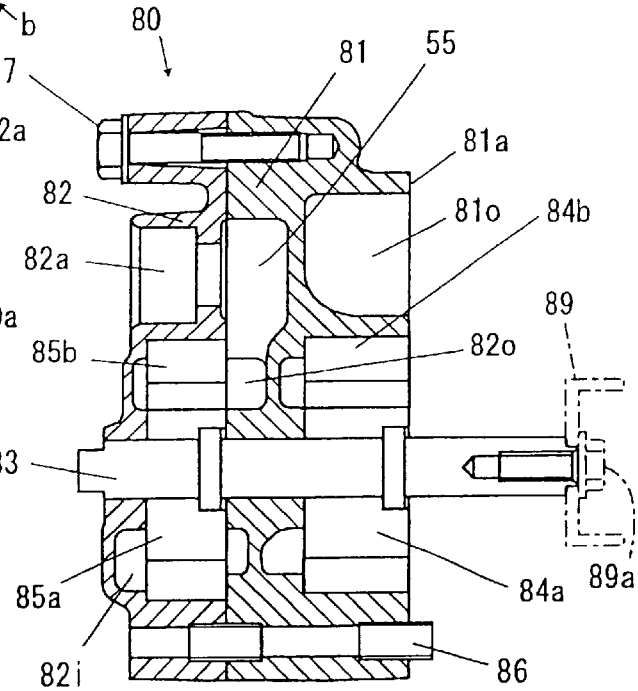

FIGS. 16(*a*) and 16(*b*) are views showing the oil pump 80. FIG. 16(*a*) is a front view and FIG. 16(*b*) is a sectional view taken on line b—b of FIG. 16(*a*).

Referring to FIGS. 16(*a*) and 16(*b*) and FIG. 8, the oil pump 80 includes a first case 81 joined to the tank main body 60 and a second case 82 joined to the first case 81. A pump shaft 83 is provided so as to pass through the first and second cases 81 and 82. An oil recovery inner rotor 84*a* is connected to the pump shaft 83 in the first case 81. An outer rotor 84*b* is rotatably provided on the outer periphery of the inner rotor 84*a*. An oil supply inner rotor 85*a* is connected to the pump shaft 83 in the second case 82. An outer rotor 85*b* is rotatably provided on the outer periphery of the inner rotor 85*a*. In the figures, reference numeral 86 denotes a dowel pin.

The oil recovery inner rotor 84*a* and the outer rotor 84*b* form an oil recover pump in cooperation with the first case 81. The oil supply inner rotor 85*a* and the outer rotor 85*b* form an oil supply pump in cooperation with the first and second cases 81 and 82.

The oil pump 80 is assembled as shown in FIGS. 16(*a*) and 16(*b*). The first case 81 is connected to the second case 82 with a bolt 87. The contact plane 81*a*, which is to be joined to the tank main body 60 of the first case 81, is joined to the contact plane 69 (see FIGS. 9(*a*) and 9(*b*)). The contact plane 69 has the same shape as that of the contact plane 81*a* and is formed on the front plane of the oil tank main body 60. A bolt 88 (see FIG. 8) is inserted in a hole 80*a* passing through the first and second cases 81 and 82, whereby the oil pump 80 is mounted to the front plane of the tank main body 60.

After the oil pump 80 is mounted to the tank main body 60, a coupling 89 is fixed, from the back surface side of the tank main body 60, to a rear end of the pump shaft 83 with a bolt 89*a*.

After the oil pump 80 and its coupling 89 are mounted to the tank main body 60, the oil cooler 90 (to be described below) is mounted to the tank main body 60. The tank main body 60 is then mounted to the front plane of the engine 20 in such a manner that the coupling 89 is coupled to the coupling 111 (as described above).

Referring to FIGS. 6 and 9(*b*), the water-cooled type oil cooler 90 is mounted to the front surface side of the oil cooler 90 mounting portion 64 of the tank main body 60. The mounting portion 64 of the tank main body 60 has an upper hole 64*a* and a lower hole 64*b* in communication with an oil passage (to be described below).

As shown in FIG. 6, the oil cooler 90 has a plurality of heat exchange plates 91 allowing oil to pass therethrough. An oil inlet pipe 92 is in communication with the insides of upper portions of the plates 91. An oil outlet pipe 93 is in communication with the insides of lower portions of the plates 91. Flange portions 94 and 95 are provided for mounting the oil cooler 90 to the tank main body 60.

The oil cooler 90 is mounted to the mounting portion 64 of the tank main body 60 by fastening the flange portions 94 and 95 to the tank main body 60 with bolts (not shown) in a state where the inlet pipe 92 is connected to the upper hole 64*a* of the tank main body 60 and the outlet pipe 93 is connected to the lower hole 64*b* of the tank main body 60. In FIG. 15, reference numeral 96 denotes a bolt insertion hole provided in each of the flange portions 94 and 95.

A cooling water introducing pipe 97 is provided in the tank main body 60. The cooling water introduction pipe 97 is in communication with a hole 64*c* (see FIG. 15) opened in the mounting portion 64, for introducing cooling water in the mounting portion 64 and the oil cooler accommodating portion 74 of the cover 70. The cover 70 is provided with a water discharge pipe 78 (see, FIGS. 12(*a*) to 12(*d*), FIGS. 13(*a*) to 13(*c*), and FIG. 14). A cooling water hose 97*a* from a cooling water takeoff portion 30*a* (see FIG. 7) in the jet pump 30 is connected to the introducing pipe 97 directly, i.e., without interposition of any cooling object therebetween. A drainage pipe 23*c* is connected to the discharge pipe 78 (see FIG. 6). Water from the drainage pipe 78 is supplied to a water jacket of the exhaust manifold 24 via the drainage pipe 23*c*.

After the tank main body 60, the oil pump 80, and the oil cooler 90 are mounted on the front plane of the engine 20 (as described above) a rear end 131 of a relief valve 130 is fitted in a hole 82*a* formed in a front plane of the second case 82 of the oil pump 80 and the cover 70 is joined to a front plane of the tank main body 60 in such a manner that a leading end 132 of the relief valve 130 is pressed by the above-described pressing portion 73 (see FIG. 8 and FIGS. 16(*a*) and 16(*b*)). Furthermore, the cover 70 is fixed to the tank main body 60 with bolts (not shown). In FIG. 12(*a*), reference numerals 76 each identify bolt insertion holes, which allow the bolts for fixing the cover 70 to the tank main body 60 to pass therethrough. As is apparent from FIG. 8, the relief valve 130 is horizontally disposed.

In a state where the cover 70 is joined to the tank main body 60, a single vertically-elongated oil storageportion is formed by both of the oil storage portions 65 and 75. Furthermore, the baffle plates 65*a* and 75*a* are joined to each other by joining the cover 70 to the tank main body 60. The baffle plates 65*a* and 75*a* are formed in both of the oil storage portions in such a manner as to be opposed to each other. An oil filter 100 is mounted to the oil filter 100 mounting portion 68 of the tank main body 60.

In a state where the engine 20 is mounted on the watercraft body 11, the engine 20 and the oil filter 100 are aligned with an opening 15*a* of the deck 15 as shown in FIGS. 2 and 4. The opening 15*a* of the deck 15 is opened by removing the seat 12, which is removably mounted on the watercraft body 11, from the watercraft body 11.

In a state where the oil tank 50 (including the tank main body 60, the cover 70, and the oil pump 80, the oil cooler 90 and the relief valve 130 contained in the cover 70) is mounted to the front plane of the engine 20 and the oil filter 100 is mounted to the mounting portion 68 of the tank main body 60 as described above, the following oil passages are formed.

Referring to FIGS. 5 and 8, an oil recovery passage 51 is formed between the front plane of the tank main body 60 and the back surface of the first case 81 of the oil pump 80. The recovery passage 51 includes an oil passage 51*a* (see FIG. 9(*b*)) formed on the tank main body 60 side. An oil passage 51*b* is formed in a portion of the oil pump 80 on the first case 81 side in such a manner as to be opposed to the oil passage 51*a*. A lower end 51*c* of the oil recovery passage 51 is in communication with an oil pan 28 of the engine 20 via a pipe 52. An upper end 51*d* of the oil recovery passage 51 is in communication with a recovery oil suction port 81*i* formed in a portion of the oil pump 80 on the first case 81 side.

Similarly, a recovery oil discharge passage 53 is formed between the front plane of the tank main body 60 and the back surface of the first case 81 of the oil pump 80. The recovery oil discharge passage 53 includes an oil passage 53*a* (see FIG. 9(*b*)) formed on the tank main body 60 side. A recovery oil discharge port 81*o* is formed in a portion of the oil pump 80 on the first case 81 side in such a manner as to be opposed to the oil passage 53*a*. An upper end 53*b* of the recovery oil discharge passage 53 is opened in the oil tank 50, i.e., in the oil storage portions (see FIGS. 9(*b*) and 15).

Referring to FIG. 8, a supplied oil suction passage 54 and a supplied oil discharge passage 55 are formed between the front plane of the first case 81 of the oil pump 80 and the back surface of the second case 82 of the oil pump 80. A lower end 54*a* of the suction passage 54 is opened in the oil tank 50, i.e., in the oil storage portions. An upper end 54*b* of the suction passage 54 is in communication with a supplied oil suction port 82*i* of an oil supply pump (see FIG. 16(*b*)). A screen oil filter 54*c* is provided in the suction passage 54. A lower end 55*a* of the discharge passage 55 is in communication with a supplied oil discharge port 82*o* of the oil supply pump. An upper end 55*b* of the discharge passage 55 passes through an upper portion of the first case 81 in the horizontal direction, to be in communication with a horizontal hole 60*a* formed in the tank main body 60 (see FIGS. 9(*b*) and 15). As shown in FIGS. 8, 9(*b*) and 15, the horizontal hole 60*a* is in communication with a vertical hole 60*b* formed in the tank main body 60. An upper end 60*c* of the vertical hole 60*b* is opened in the oil filter 100 mounting portion 68 (see FIGS. 9(*a*) and 11(*a*)) in such a manner as to be formed into a ring-shape in a plan view. An oil flow-in passage 101 of the oil filter 100 is in communication with the upper end 60*c* of the vertical hole 60*b*.

The above-described relief valve 130 mounting hole 82*a* is opened in the discharge passage. The relief valve 130 is mounted in the mounting hole 82*a* (as described above).

A male screw is provided in an oil outlet pipe 102 in the oil filter 100. The oil filter 100 is mounted to the mounting portion 68 of the tank main body 60 by screwing the male screw portion of the oil outlet pipe 102 in a female thread hole 60*d* formed in the mounting portion 68 of the tank main body 60 (see FIGS. 9(*a*), 9(*b*), 11 (*a*) and 15).

A peripheral wall 68*a* is formed integrally with the mounting portion 68. An oil receiving portion 68*c* is formed by the peripheral wall 68*a* and a side wall surface 68*b*, continuous to the peripheral wall 68*a*, of the tank main body 60. Accordingly, if oil is dropped from the oil filter 100 when the oil filter 100 is mounted or dismounted to or from the mounting portion 68, then it is received on the oil receiving portion 68*c* and is returned into the oil tank via the female thread hole 60*d* or the opening 60*c*. As a result, the inside of the watercraft body 11 becomes less contaminated from oil dropped from the oil filter 100.

Referring to FIGS. 9(*a*), 9(*b*), 11(*a*) and 15, a vertical hole 60*e* and a horizontal hole 60*f* are in communication with a lower end of the vertical hole 60*e*. The vertical hole 60*e* and the horizontal hole 60*f* are formed in a lower portion of the female thread hole 60*d*. The horizontal hole 60*f* is in communication with the inlet pipe 92 of the oil cooler 90 via the upper hole 64*a* formed in the oil cooler 90 mounting portion 64 (see FIGS. 6 and 15).

As described above, the outlet pipe 93 of the oil cooler 90 is connected to the lower hole 64*b* of the tank main body 60. Referring to FIG. 11(*b*), an oil passage 60*g* in communication with the lower hole 64*b* and an oil distribution passage 60*h* in communication with the passage 60*g* are formed in the lower hole 64*b*. The oil distribution passage 60*h* is in communication with three passages: a main gallery oil supply passage 60*i* for supplying oil to a main gallery 20*a* of the engine 20 (see FIG. 5); a left balancer oil supply passage 60*j* for supplying oil to a bearing portion of the left balancer 114L; and a right balancer oil supply passage 60*k* for supplying oil to a bearing portion of the right balancer 114R. Each of the oil supply passages 60*j* and 60*k* for the balancers 114L and 114R is in communication with an oil distribution passage 60*h* via a narrow passage 60*m*. One end 60*h*1 of the oil distribution passage 60*h* is closed with a plug 60*n* (see FIG. 6).

Figure 17:
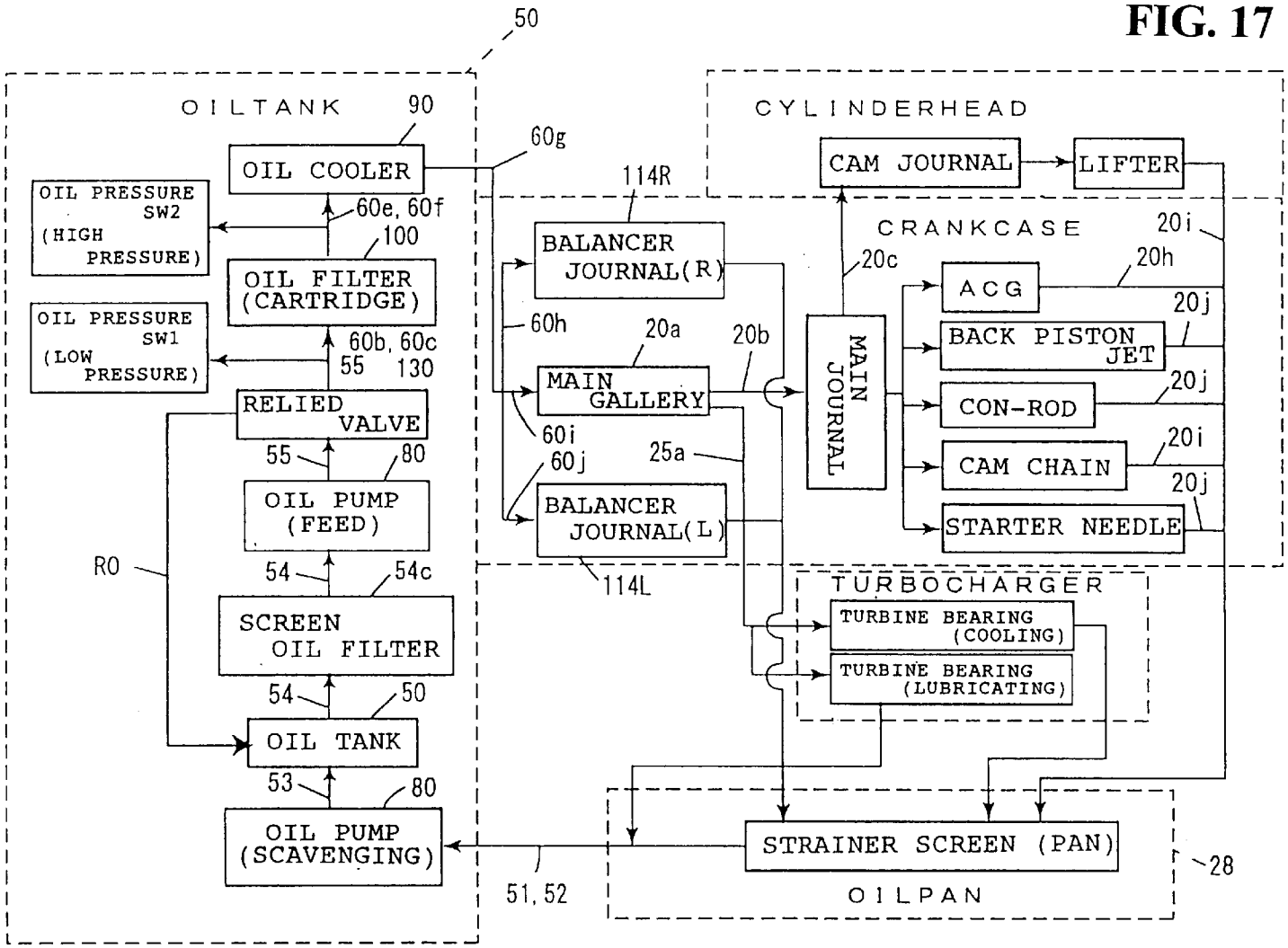
FIG. 17 is a diagram showing an oil circulation route.

A route of oil supplied to the main gallery 20*a* of the engine 20 is shown in FIG. 17 (which is an oil circulation route diagram). The route of oil supplied to the main gallery 20*a* is basically classified into two routes.

The first route extends from a route 20*b* (see FIG. 5) to a bearing portion of the crankshaft (main journal) 21. Oil is supplied to the bearing portion of the crankshaft 21 via such a first route. The second route extends from a rear end 20*a*1 of the main gallery 20*a* to a turbine bearing portion of the turbo-charger 25 via a pipe 25*a* (see FIG. 7). Oil is supplied to the turbine bearing portion of the turbo-charger 25 via such a second route for cooling and lubricating the turbine bearing portion. The oil, which has been used for cooling and lubricating the turbine bearing portion of the turbo-charger 25, is recovered to the oil pan 28 via pipes 25*b* and 25*c* (see FIG. 6).

The oil, which has been supplied to the bearing portion of the crankshaft 21, is then supplied to a cam journal 20*d* portion and a lifter portion of a cylinder head via a route 20*c* (see FIG. 5) for lubricating the cam journal 20*d* portion and the lifter portion, and is returned to the oil pan 28 via a chain chamber 20*i*.

The oil, which has been supplied to the bearing portion of the crankshaft 21, is then supplied to the ACG, a piston back side jetting nozzle, a connecting rod, a cam chain, and a starter needle, and is returned to the oil pan 28 via the corresponding recovery passages. In FIG. 5, reference numeral 20*e* denotes a jet nozzle for jetting oil to the back side of the piston for cooling the piston; 20*f* is a passage in communication with the connecting rod portion; 20*g* is a cam chain; and 20*h* is a return passage for returning oil from an ACG chamber 110*c*.

The oil, which has been supplied to the ACG chamber 110*c*, is returned to the oil pan 28 via the return passage 20*h*. The oil jetted from the jet nozzle 20*e* to the back side of the piston, supplied to the connecting rod, and supplied to the starter needle are each returned to the oil pan 28 via a crank chamber 20*j*.

As is apparent from the above description, referring mainly to FIG. 17, the general flow of oil is as follows: Oil tank 50→suction passage 54→screen oil filter 54*c*→oil pump (supply pump) 80→discharge passage 55 (and relief valve 130, horizontal hole 60*a*, vertical hole 60*b*, and ring-shaped opening 60*c*)→oil filter 100→vertical hole 60*e* and horizontal hole 60*f*→oil cooler 90→oil passage 60*g* and oil distribution passage 60*h*→main gallery oil supply passage 60*i*, left balancer oil supply passage 60*j* and right balancer oil supply passage 60*k*→main gallery 20*a*, left balancer 114L and right balancer 114R.

The relief oil, denoted by character RO, flowing from the relief valve 130 is directly returned to the inside of the oil tank 50. The oil, which has been supplied to the left balancer 114L and the right balancer 114R, is returned to the oil pan 28 via the crank chamber 20*j*. The oil, which has been supplied from the main gallery 20*a* to the above-described respective portions, is returned to the oil pan 28 as described above.

The oil thus returned to the oil pan 28 is the recovered to the oil tank 50 via the pipe 52, the oil recovery passage 51, the oil pump (recovery pump) 80, and the recovery oil discharge passage 53, and is circulated again from the suction passage 54 to the above-described portions by way of the above-described routes.

As described above, the first sub-breather chamber 67 is formed in the tank main body 60 and the second sub-breather chamber 77 is formed in the cover 70. As shown in FIG. 9(*b*), the first sub-breather chamber 67 is partitioned from the oil storage portion 65 of the tank main body 60 by means of a partition wall 67*a*. As shown in FIG. 13(*a*), the second sub-breather chamber 77 is partitioned from the oil storage portion 75 of the cover 70 by means of a partition wall 77*a*. Each of the sub-breather chambers 67 and 77 is formed into a vertically-elongated shape.

The contact plane 62 of the tank main body 60 is joined to the contact plane 71 of the cover 70 via a metal gasket 79, part of which is shown in FIG. 13(*a*). The metal gasket 79 has a shape basically matched to the shape of each of the contact planes 62 and 71; however, the metal gasket 79 extends inwardly in each of the first sub-breather chamber 67 and the second sub-breather chamber 77. The extending portion of the metal gasket 79, which is denoted by reference numeral 79*a*, is configured as a partition plate for partitioning the first sub-breather chamber 67 and the second sub-breather chamber 77 from each other. It is to be noted that the extending portion 79*a* does not perfectly partition the first sub-breather chamber 67 and the second sub-breather chamber 77 from each other. Concretely, a space under a lower end 79*b* of the metal gasket 79 is opened and the first sub-breather chamber 67 and the second sub-breather chamber 77 are in communication with each other via such an opening portion, which is denoted by reference numeral 79*c*.

A breathing passage 67*h* is formed in the oil storage portion of the tank main body 60 at a position adjacent to the first sub-breather chamber 67 (see FIG. 9(*b*)). Similarly, a breathing passage 77*h* is formed in the oil storage portion of the cover 70 at a position adjacent to the second sub-breather chamber 77 (see FIG. 13(*a*)). When the cover 70 is joined to the tank main body 60, the breathing passages 67*h* and 77*h* form a single breathing passage. A lower end of the breathing passage 67*h* on the tank main body 60 side is in communication with the inside of the cover portion 66 via an opening 67*i* (see FIG. 10). Accordingly, the oil storage portion of the oil tank 50 also has a breathing function.

Referring to FIGS. 9(*a*) to 9(*d*), a breathing gas inlet pipe 67*b* in communication with the first sub-breather chamber 67 is provided in an upper portion of the first sub-breather chamber 67.

On the other hand, as shown in FIG. 4, a main breathing chamber 29*a* is formed in a head cover 29 of the engine 20. To make the entire height of the engine 20 as low as possible, the volume of the main breathing chamber 29*a* in the head cover 29 is made as small as possible. A breathing gas outlet pipe 29*b* is provided in the head cover 29, and the outlet pipe 29*b* is connected to the inlet pipe 67*b* of the first sub-breathing chamber 67 via a breather pipe 67*c*.

Referring to FIGS. 12(*a*) and 13, a breathing gas outlet pipe 77*b* is in communication with the second sub-breather chamber 77. The breathing gas outlet pipe 77*b* is provided in an upper portion of the second sub-breather chamber 77. The outlet pipe 77*b* is provided at a position lower than that of the inlet pipe 67*b* of the first sub-breather chamber 67 (see FIG. 4). The outlet pipe 77*b* is connected, in an intake system of the engine 20, to an intake box (not shown) disposed on the upstream side from the turbo-charger 25 via the breather pipe 77*c* (see FIG. 13(*c*)), to return breathing gas to the intake box.

Referring to FIGS. 8, 9(*a*) and 9(*b*), and 10, a return passage 67*d* for returning oil, which has been separated in the first and second sub-breather chambers 67 and 77, is provided at a lower end of the first sub-breather chamber 67. The return passage 67*d* is formed in the tank main body 60 and is in communication with the ACG chamber 110*c*. Accordingly, the oil, which has been separated in the first and second sub-breather chambers 67 and 77, enters the ACG chamber 110*c* via the return passage 67*d*, and is returned to the oil pan 28 via the above-described return passage 20*h*.

According to the above-described breather structure, at the time of normal operation, a breathing gas generated in the engine 20 enters the main breathing chamber 29*a* in the head cover 29, the first sub-breather chamber 67 via the breather pipe 67*c*, and the second breather chamber 77 via the opening portion 79*c* (communication passage between the first and second sub-breather chambers 67 and 77) provided at the lower end of the first sub-breather chamber 67, and is returned from the outlet pipe 77*b* of the second sub-breather chamber 77 to the intake box via the breather pipe 77*c*.

The oil, which has been separated in the course of passing of the breathing gas through the first and second sub-breather chambers 67 and 77, is returned, as described above, to the oil pan 28 via the return passage 67*d*, the ACG chamber 110*c*, and the return passage 20*h*.

A personal watercraft of this type is mainly used for leisure, and therefore, it may be turned over often. According to the above-described breather structure, however, the flow of oil out of the above-described oil passages provided in the engine 20, the oil tank 50, and the like can be prevented as described below.

Figure 18B:
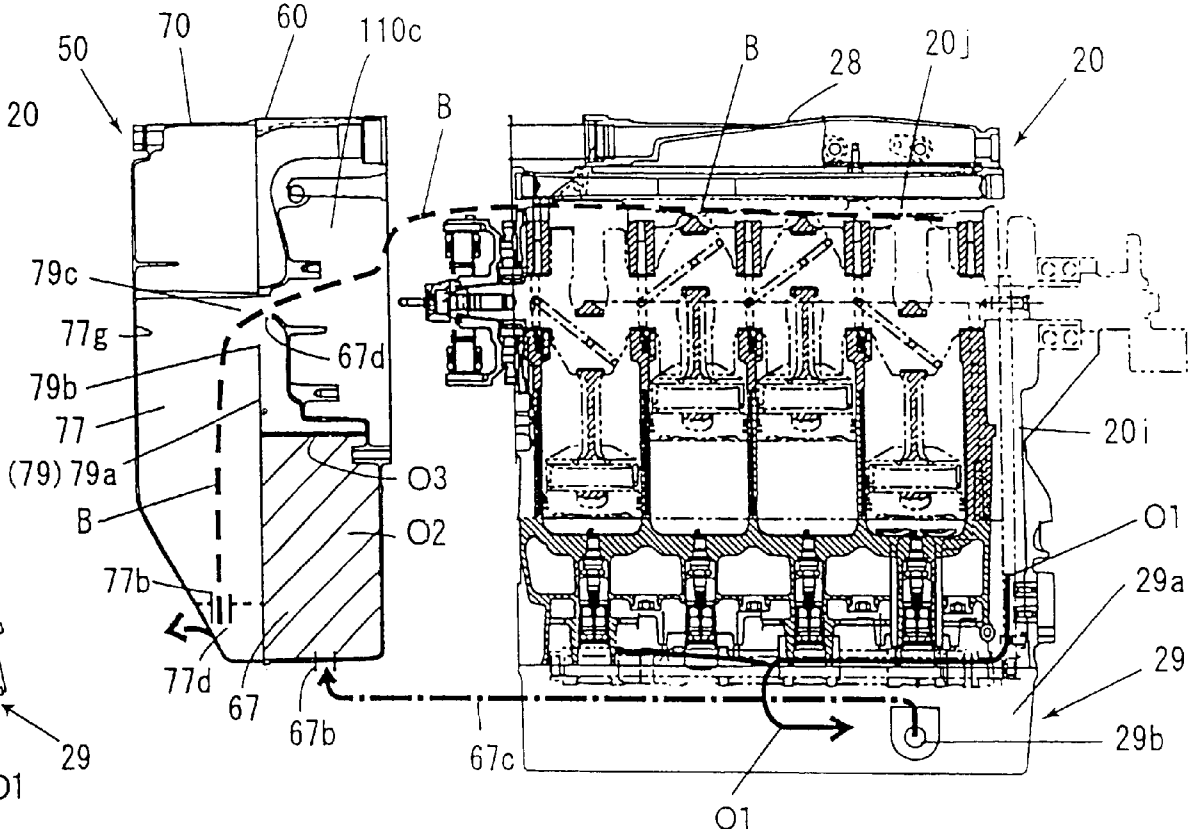
FIGS. 18(*a*) and 18(*b*) are schematic views showing states of the engine 20 and the oil tank 50 at the time of turn-over of a watercraft 10, wherein FIG. 18(*a*) is a front view and FIG. 18(*b*) is a side view.
Figure 18A:
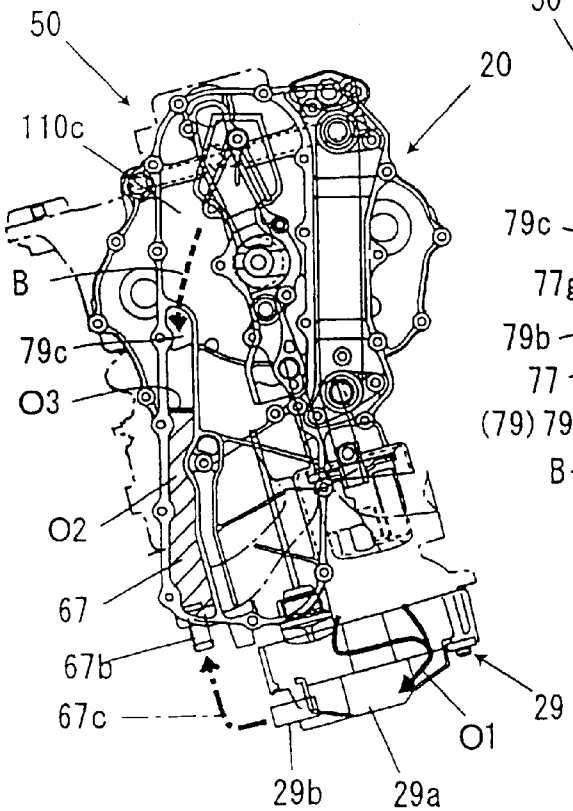

FIGS. 18(*a*) and 18(*b*) are schematic views showing states of the engine 20 and the oil tank 50 at the time of turn-over of the watercraft 10. FIG. 18(*a*) is a front view, and FIG.

18(*b*) is a side view. It should be noted that, in order to clarify the flows of oil and breathing gas, the engine 20 and the oil tank 50 are depicted as being separated from each other in FIG. 18(*b*).

As shown in the figures, when postures of the engine 20 and the oil tank 50 are vertically reversed by turn-over of the watercraft 10, the oil, which has been present mainly in the crank chamber 20*j* of the engine 20, the oil pan 28, and the like flows down to the main breathing chamber 29*a* as shown by an arrow O1. It is to be noted that the oil, which has been present in the oil pan 28, flows down to the main breathing chamber 29*a* via the chain chamber 20*i*.

Since the volume of the main breathing chamber 29*a* is made as small as possible to make the entire height of the engine as low as possible (as described above), only part of the oil in the engine 20 can be stored in the main breathing chamber 29*a*. The remainder of the oil flows in the first sub-breather chamber 67 via the breather pipe 67*c*. In the figures, character O2 (hatched portion) denotes the oil having flown in the first sub-breather chamber 67. Character O3 denotes an upper plane of the oil (oil level). As shown in the figures, although the oil flows in the first sub-breather chamber 67, it does not flow in the second sub-breather chamber 77 because the second sub-breather chamber 77 is partitioned from the first sub-breather chamber 67 by means of the extending portion 79*a* of the metal gasket 79 as described above (see FIG. 13(*a*)).

In other words, the volume of the first sub-breather chamber 67 and the lower end (upper end at the time of turn-over) of the extending portion 79*a* of the metal gasket 79 are configured such that oil does not flow in the second sub-breather chamber 77 at the time of turn-over. An oil sump portion in the first sub-breather chamber 67 is defined by the inner wall surface of the tank main body 60, the extending portion 79*a* of the metal gasket 79, and the lower end 79*b* (upper end at the time of turn-over) of the extending portion 79*a*. An oil sump portion in the engine 20 is defined by an engine upper portion (which is mainly formed by the main breathing chamber 29*a* and the cylinder head portion, and which is an engine lower portion at the time of turn-over). The total of the volume of the above oil sump portion in the first sub-breather chamber 67 and the volume of the above oil sump portion in the engine 20 is formed such that oil does not flow in the second sub-breather chamber 77. Accordingly, the total amount of oil circulating in the engine 20 and the oil tank 50 is set such that oil does not flow in the second sub-breather chamber 77 at the time of turn-over.

Since oil does not flow in the second sub-breather chamber 77 at the time of turn-over of the watercraft 10 (as described above), a situation where oil flows in the intake box via the second sub-breather chamber 77, the outlet pipe 77*b* thereof, and the breather pipe 77*c* connected to the outlet pipe 77*b* does not occur.

If oil flows in the breather pipe 77*c* connected to the outlet pipe 77*b* of the second sub-breather chamber 77 at the time of turn-over, then there may occur an problem. Specifically, as will be described later, oil having flown in the breather pipe 77*c* flows into the intake box when the watercraft 10 is recovered (returned to an original posture), and flows in the watercraft body from the intake box, to contaminate the watercraft body (which results in pollution of the environment such as the sea).

On the contrary, according to the breather structure in this embodiment, since oil does not flow in the breather pipe 77*c* in communication with the intake box, it is possible to prevent the flow of oil out of the oil passages provided in the engine 20, the oil tank 50 and the like. Accordingly, pollution of the environment is prevented.

As described above, oil is separated from the breathing gas in each of the first and second sub-breather chambers 66 and 77. The separated oil enters the ACG chamber 110*c* via the return passage 67*d* provided at the lower end of the first sub-breather chamber 67 and is returned to the oil pan 28 via the above-described return passage 20*h*. Accordingly, at the time of turn-over of the watercraft 10, a slight amount of oil adhered on a water surface 77*g* of the second sub-breather chamber 77, and oil present at the lower end of the second sub-breather chamber 77 and the return passage 67*d* flow to the outlet pipe 77*b* side of the second sub-breather chamber 77, and along the inner all surface 77*g* of the second sub-breather chamber 77.

To cope with such an inconvenience, according to this embodiment, as shown in FIGS. 13(*a*) to 13(*c*), an oil sump portion 77*d* for accumulating oil at the time of turn-over is provided in the upper portion (lower portion at the time of turn-over) of the second sub-breather chamber 77.

The oil sump portion 77*d* is formed so as to be stepped up from an opening portion 77*b*1, opened in the second sub-breather chamber 77, of the outlet pipe 77*b* via a stepped portion 77*e*. The opening portion 77*b*1 projects from a lower surface 77*f* (upper surface, at the time of turn-over) of the stepped portion 77*e* in such a manner as not to be brought into contact with the inner wall surface 77*g* of the second sub-breather chamber 77.

Accordingly, even if at the time of turn-over, the oil adhered on the wall surface of the second sub-breather chamber 77 and oil present at the lower end of the second sub-breather chamber 77 and in the return passage 67*d* flow to the outlet pipe 77*b* side and flow along the inner wall surface 77*g* of the second sub-breather chamber 77, then the oil is received and accumulated in the oil sump portion 77*d*. Therefore, the oil does not flow in the outlet pipe 77*b*. As a result, it is possible to more certainly prevent the flow of oil in the watercraft body 10.

On the other hand, even at the time of turn-over, the engine 20 may be rotating continuously. The engine 20 may often be rotated at least immediately after the watercraft 10 is turned over.

If something is not done about such circumstances, then there may occur the above-described inconvenience that the oil, which has flown from the main breathing chamber 29*a* to the first sub-breather chamber 67, overflows the lower end 79*b* (upper end, at the time of turn-over) of the extending portion 79*a* of the metal gasket 79 to the second sub-breather chamber 77 by pressure of breathing gas gradually increased in the engine 20.

According to this embodiment, however, at the time of turn-over, a breathing passage shown by a broken line B in FIGS. 18(*a*) and 18(*b*) is formed. The route extends from the inside of the crank chamber 20*j* to the intake box via the ACG chamber 110*c*, the return passage 67*d*, the opening portion 79*c* of the metal gasket 79, the second sub-breather chamber 77, the outlet pipe 77*b* thereof, and the breather pipe 77*c*. Specifically, the return passage 67*d* forms the breathing route at the time of turn-over of the watercraft 10. As a result, according to this embodiment, there does not occur the above-described inconvenience.

Figure 19B:
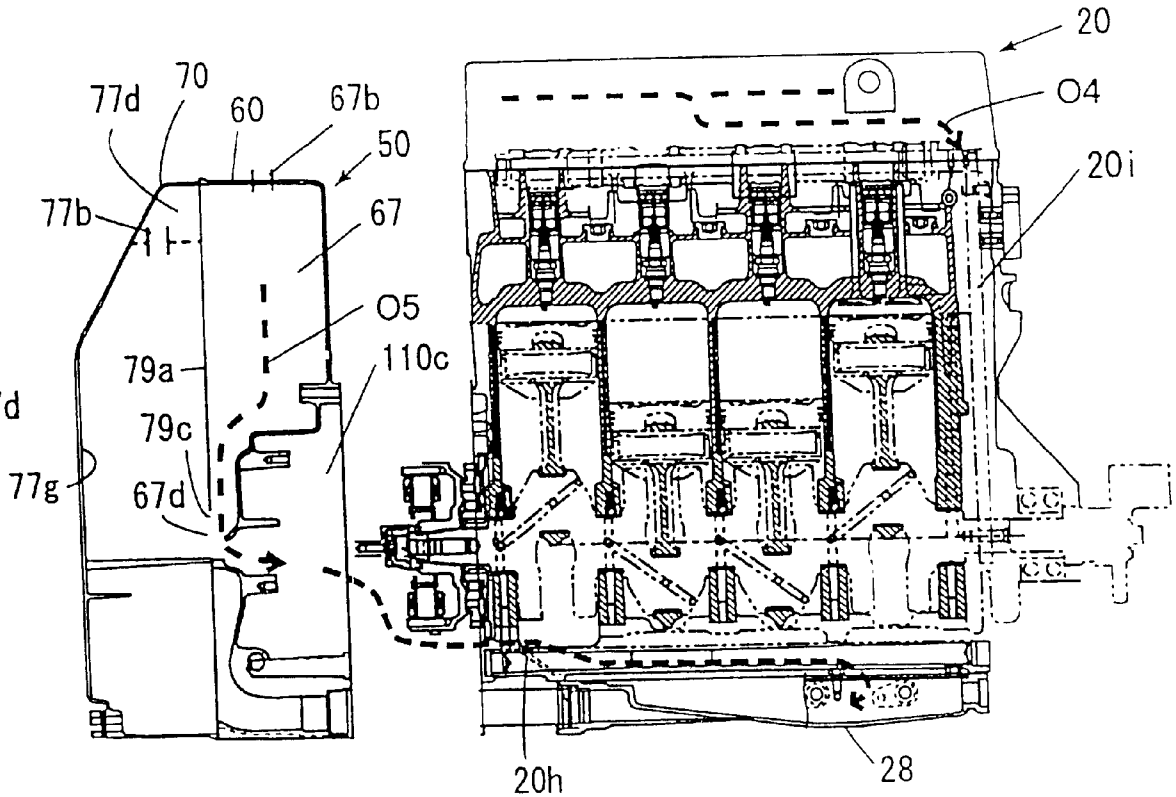
FIGS. 19(*a*) and 19(*b*) are views illustrating the return of oil when the turned-over watercraft 10 is recovered (returned to a normal posture), wherein FIG. 19(*a*) is a front view and FIG. 19(*b*) is a side view.
Figure 19A:
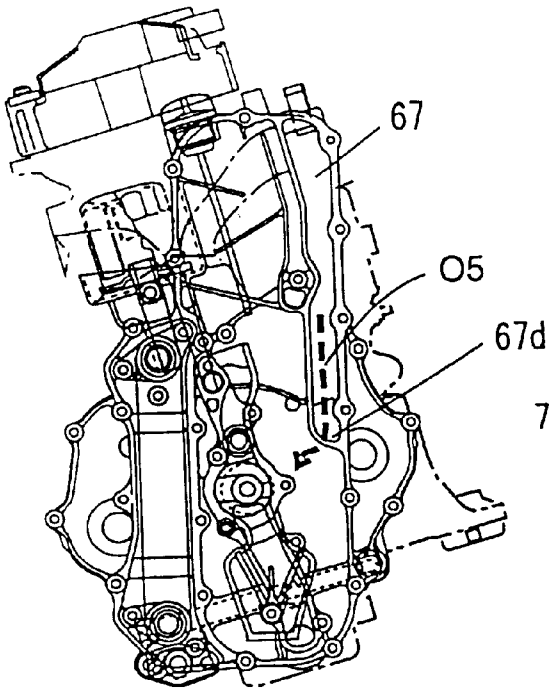
Figure 20:
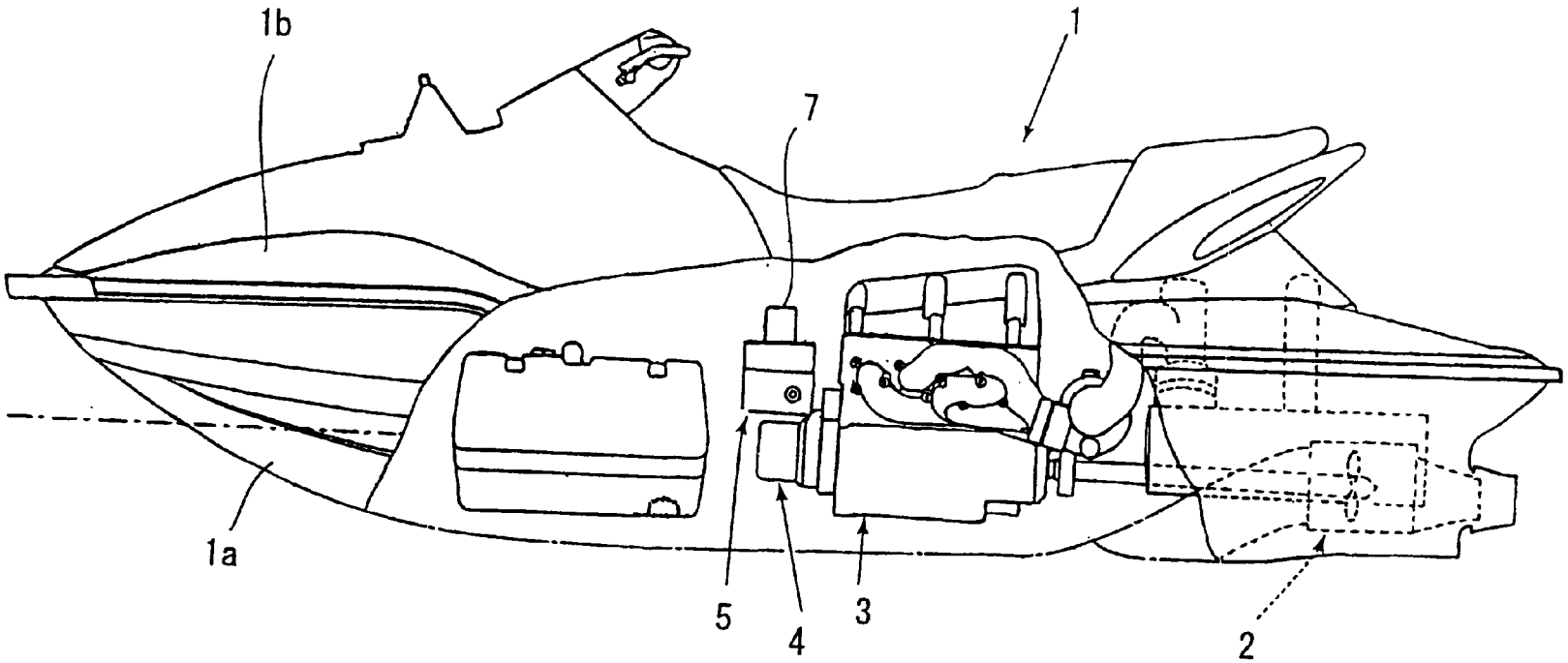
FIG. 20 BACKGROUND ART
FIG. 20 is a view illustrating a prior art lubricating system.
Figure 21:
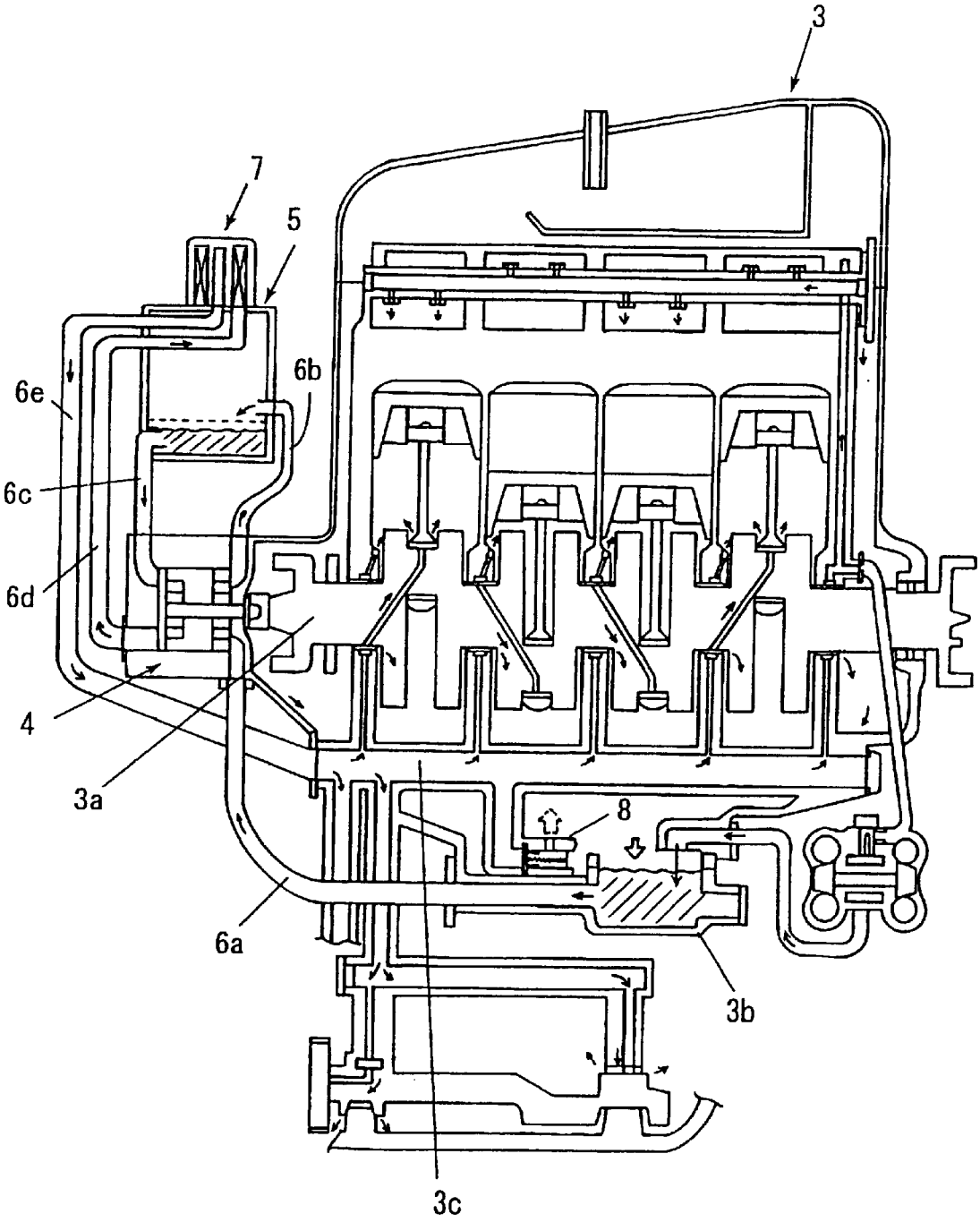
FIG. 21 BACKGROUND ART
FIG. 21 is a view illustrating the prior art lubricating system shown in FIG. 20.

FIGS. 19(*a*) and 19(*b*) are views illustrating the return of oil when the turned-over watercraft 10 is recovered (returned to a normal posture). FIG. 19(*a*) is a front view and FIG. 19(*b*) is a side view. It is to be noted that, in order to clarify the flow of oil, the engine 20 and the oil tank 50 are depicted as being separated from each other in FIG. 19(*b*).

As shown in the figures, when the turned-over watercraft 10 is recovered, the oil having been present in the upper portion (lower portion, at the time of turn-over) of the engine 20 flows down to the oil pan 28. The oil having been present in the main breathing chamber 29*a* is returned mainly via the chain chamber 20*i* as shown by an arrow O4 in FIG. 19(*b*).

The oil, which has been present in the breather pipe 67*c*, is returned to the oil pan 28 via the main breathing chamber 29*a* or flows in the first sub-breather chamber 67 depending on a tilt state of the breather pipe 67*c*.

The oil, which has been present in the first sub-breather chamber 67, is returned to the oil pan 28 via the return passage 67*d*, the ACG chamber 110*c*, and the return passage 20*h* as shown by an arrow O5.

The oil, which has been present in the oil sump portion 77*d* of the second sub-breather chamber 77, flows down along the inner wall surface 77*g* of the second sub-breather chamber 77, and is returned to the oil pan 28 via the opening portion 79*c*, the return passage 67*d*, the ACG chamber 110*c*, and the return passage 20*h*. The watercraft 10 is thus returned to the normal posture.

The system for lubricating an engine for a personal watercraft, configured as described above, has the following functions and effects.

The engine 20 for driving the jet propelling pump 30 is provided in the watercraft body 11 surrounded by the hull 14 and the deck 15 in such a manner as to extend in the length direction of the watercraft body 11 and the oil tank 50 is provided on the extension of the crankshaft 21 of the engine 20, and also the oil pump 80 driven by the crankshaft 21 is provided in the oil tank 50. Accordingly, it is possible to simplify the oil piping structure. At least the piping (6*b* and 6*c*) having been required for connecting the oil pump to the oil tank can be omitted.

The relief valve 130 for controlling a discharge pressure of the oil pump 80 is provided in the oil tank 50. Accordingly, relief oil from the relief valve 130 is discharged in the oil tank 50. Therefore, it is possible to reduce the volume of the oil pump 130 as compared with a configuration that relief oil 130 is discharged in the engine 20 (for example, in the oil pan (3*b*) as in the above-described background art).

The oil tank 50 is composed of the oil main body 60 and the cover 70 and the relief valve 130 is accommodated in the oil tank 50 in such a manner as to be in communication with the discharge passage 55 of the oil pump 80 and to be brought into contact with the cover 70. Accordingly, it is possible to simplify the accommodation and fixture of the relief valve 130.

The tank main body 60 and the cover 70 are joined to each other with their contact planes 62 and 71 extending substantially in the vertical direction and the relief valve 130 is accommodated in the oil tank 50 in such a manner as to extend in the horizontal direction. Accordingly, it is possible to easily assemble the relief valve 130.

The oil pump 80 is accommodated in a portion, on the tank main body 60 side, of the oil tank 50 and the suction/discharge passages 51, 53, 60*a* and 60*b* of the oil pump 80 are formed integrally with the tank main body 60. Accordingly, it is possible to further simplify the oil piping structure.

The tank main body 60 covers drive chambers for accessories such as the ACG, the balancer shaft 114, and the starter motor 120 of the engine 20. Accordingly, it is possible to eliminate the need of provision of covers specialized for covering the drive chambers for the accessories. Furthermore, it is possible to make the engine 20 further compact. In addition, it is possible to reduce the number of parts and to obtain a noise absorption effect due to oil as compared with single covers liable to induce radiation noise occurring from the engine 20. Accordingly, it is possible to further reduce the degree of noise of the engine 20.

The oil filter in communication with the oil pump 80 in the oil tank 50 is provided in the upper portion of the oil tank 50 and the passages 60*a*, 60*b*, 60*e* and 60*f* for communicating the oil tank 50 to the oil filter 100 are formed integrally with the oil tank 50. Accordingly, it is possible to further simplify the oil piping structure.

The oil filter 100 is aligned with the opening 15*a* of the deck 15. Accordingly, it is possible to easily perform the necessary work for exchanging the oil filter 100.

The breather chambers (the first sub-breather chamber 67 and the second sub-breather chamber 77 in this embodiment) of the dry sump type engine in which the oil tank 50 for storing engine oil is provided independently from the engine 20, are defined in the oil tank 50 and the breather chambers (67 and 77) are in communication with the engine 20. Accordingly, it is possible to eliminate the need for a breather chamber in the head cover 29 or the like of the engine 20. Furthermore, if such a breather chamber is required to be provided, it is possible to significantly reduce the volume of the breather chamber.

In this embodiment, although the main breathing chamber 29*a* is provided in the head cover 29 of the engine 20, the volume of the main breathing chamber 29*a* is significantly small. Accordingly, the entire size, particularly, the entire height of the engine 20 can be made small, so that the four-cycle engine 20 can be mounted even in the small watercraft body 11. As a result, it is possible to reduce the degree of environmental pollution and noise occurring from the small watercraft 10.

The oil tank 50 is composed of the divided cases 60 and 70 joined to each other, and the breather chambers (67 and 77) are formed by joining the divided cases 60 and 70 to each other. Accordingly, the volume, shape, and the like of each of the breather chambers can be freely set. In this embodiment, the volume, shape, and the like of each of the breather chambers (67 and 77) are configured as described above.

The breathing gas inlet 67*b* of the breather chamber (67) is provided in the upper portion of the oil tank 50 and the breathing gas outlet 77*b* of the breather chamber (77) is provided at a position lower than that of the breathing gas inlet 67*b* and the return passage 67*d* for returning oil having been separated in the breather chambers (67 and 77) is provided in the oil tank 50 (in the tank main body 60 in this embodiment). Accordingly, it is possible to ensure the height required for gas-liquid separation in the breather chambers (67 and 77), and also to simply return the separated oil.

The divided cases 60 and 70 are joined to each other via the gasket 79 and the breather chamber section is partially partitioned into the first breather chamber 67 and the second breather chamber 77 by means of the gasket 79 and the breathing gas inlet 67*b* is provided in the first breather chamber 67 and the breathing gas outlet 77*b* is provided in the second breather chamber 77. Accordingly, it is possible to more certainly perform gas-liquid separation.

The oil tank 50 forms the cover portion 66*a* of the ACG disposed at the end of the crankshaft 21 of the engine 20. Accordingly, it is possible to reduce the number of parts and to obtain a noise absorption effect due to oil as compared with a single cover liable to induce radiation noise occurring from the engine 20. Accordingly, it is possible to further reduce the degree of noise occurring from the engine 20.

The pulser 118 for taking out a signal is provided on the outer periphery of the ACG in such a manner as to overlap with the oil tank 50 in a direction along the crank shaft 21. Accordingly, it is not required to elongate the axial length for the pulser 118. As a result, it is possible to make the engine 20 more compact.

The water-cooled type oil cooler 90 accommodating portions 64 and 74 are formed integrally with the oil tank 50. Accordingly, it is possible to simplify an oil piping structure and a cooling water piping structure.

The oil filter 100 is provided in the oil tank 50 and the oil cooler 90 is interposed in the oil passage extending from the oil filter 100 to the main gallery 20*a* of the engine 20. Accordingly, it is possible to supply the most cooled oil to the main gallery 20*a* of the engine 20, and hence to efficiently cool the engine 20.

The engine 20 is an engine mounted on a small watercraft for driving the jet pump 30 and cooling water from the cooling water takeoff portion 30*a* of the jet pump 30 is first supplied to the water-cooled type oil cooler 90 accommodating portion 74. Accordingly, it is possible to efficiently cool not only oil passing through the oil cooler 90 but also oil stored in the oil tank 50.

The engine 20 is mounted on a small watercraft and the breather chamber (67) forms the oil sump portion for accumulating oil at the time of turn-over of the watercraft. Accordingly, it is possible to prevent the flow-out of oil at the time of turn-over.

The engine 20 is mounted on a small watercraft and the return passage 67*d* forms the breathing passage at the time of turn-over of the watercraft. Accordingly, it is possible to certainly prevent the flow-out of oil at the time of turn-over.

The engine 20 is mounted on a small watercraft and the sump portion 77*d* for oil which counter flows in the return passage 67*d* at the time of turn-over of the watercraft is provided in the upper portion (lower portion, at the time of turn-over) of the second breather chamber 77. Accordingly, it is possible to more certainly prevent the flow-out of oil at the time of turn-over.

The oil storage portion of the oil tank 50 is vertically elongated, it is possible to reduce entrainment of air in oil due to transverse G at the time of running of the watercraft, and since the multi-stepped baffle plates 65*a* and 75*a* are provided in the oil storage portion. Accordingly, it is possible to reduce entrainment of air in oil due to vertical G at the time of running of the watercraft 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for lubricating an engine for a personal watercraft, the personal watercraft including an engine for driving a jet propelling pump, the engine being provided in a body of the personal watercraft surrounded by a hull and a deck, the engine extending in a length direction of the body, said system comprising:

an oil tank, said oil tank being provided on an extension of a crankshaft of the engine; and an oil pump driven by a pump shaft mounted on an end of the crankshaft, said oil pump being provided in said oil tank.

2. The system for lubricating an engine for a personal watercraft according to claim 1, wherein a relief valve for controlling a discharge pressure of said oil pump is provided in said oil tank.

3. The system for lubricating an engine for a personal watercraft according to claim 2, wherein said oil tank is composed of a tank main body and a cover, and said relief valve is accommodated in said oil tank in communication with a discharge passage of said oil pump, said relief valve being in direct contact with said cover.

4. The system for lubricating an engine for a personal watercraft according to claim 3, wherein said tank main body and said cover are joined to each other with contact planes thereof extending substantially in a vertical direction, and said relief valve is accommodated in said oil tank extending in a horizontal direction.

5. The system for lubricating an engine for a personal watercraft according to claim 4, wherein said oil pump is accommodated in a tank main body side portion of said oil tank, and suction/discharge passages of said oil pump are formed by said tank main body.

6. The system for lubricating an engine for a personal watercraft according to claim 4, wherein said tank main body covers drive chambers for accessories of the engine including at least one of an AC generator, a balancer shaft, and a starter motor.

7. The system for lubricating an engine for a personal watercraft according to claim 3, wherein said oil pump is accommodated in a tank main body side portion of said oil tank, and suction/discharge passages of said oil pump are formed by said tank main body.

8. The system for lubricating an engine for a personal watercraft according to claim 7, wherein said tank main body covers drive chambers for accessories of the engine including at least one of an AC generator, a balancer shaft, and a starter motor.

9. The system for lubricating an engine for a personal watercraft according to claim 3, wherein said tank main body covers drive chambers for accessories of the engine including at least one of an AC generator, a balancer shaft, and a starter motor.

10. The system for lubricating an engine for a personal watercraft according to claim 1, wherein an oil filter is in communication with said oil pump of said oil tank, said oil filter being provided in an upper portion of said oil tank, and a communication passage for communicating said oil tank to said oil filter is formed integrally with said oil tank.

11. The system for lubricating an engine for a personal watercraft according to claim 10, wherein the engine and said oil filter are aligned with an opening of the deck in the personal watercraft.

12. The system for lubricating an engine for a personal watercraft according to claim 10, wherein a mounting portion for mounting said oil filter is provided on an upper portion of said oil tank, and an oil receiving portion is formed in said mounting portion, said oil receiving portion being in communication with said communication passage.

13. A personal watercraft, comprising:

a watercraft body including a hull and a deck connected together with a space therebetween;

a jet propelling pump mounted within said space;

an engine for driving said jet propelling pump, said engine being provided in said watercraft body surrounded by the hull and the deck, said engine extending in a length direction of said watercraft body;

an oil tank, said oil tank being provided on an extension of a crankshaft of said engine; and an oil pump driven by a pump shaft mounted on an end of said crankshaft, said oil pump being provided in said oil tank.

14. The personal watercraft according to claim 13, wherein a relief valve for controlling a discharge pressure of said oil pump is provided in said oil tank.

15. The personal watercraft according to claim 14, wherein said oil tank is composed of a tank main body and a cover, and said relief valve is accommodated in said oil tank in communication with a discharge passage of said oil pump, said relief valve being direct in contact with said cover.

16. The personal watercraft according to claim 15, wherein said tank main body and said cover are joined to each other with contact planes thereof extending substantially in a vertical direction, and said relief valve is accommodated in said oil tank extending in a horizontal direction.

17. The personal watercraft according to claim 16, wherein said oil pump is accommodated in a tank main body side portion of said oil tank, and suction/discharge passages of said oil pump are formed by said tank main body.

18. The personal watercraft according to claim 16, wherein said tank main body covers drive chambers for accessories of said engine including at least one of an AC generator, a balancer shaft, and a starter motor.

19. The personal watercraft according to claim 15, wherein said oil pump is accommodated in a tank main body side portion of said oil tank, and suction/discharge passages of said oil pump are formed by said tank main body.

20. The personal watercraft according to claim 19, wherein said tank main body covers drive chambers for accessories of said engine including at least one of an AC generator, a balancer shaft, and a starter motor.

21. The personal watercraft according to claim 15, wherein said tank main body covers drive chambers for accessories of said engine including at least one of an AC generator, a balancer shaft, and a starter motor.

22. The personal watercraft according to claim 13, wherein an oil filter is in communication with said oil pump of said oil tank, said oil filter being provided in an upper portion of said oil tank, and a communication passage for communicating said oil tank to said oil filter is formed integrally with said oil tank.

23. The personal watercraft according to claim 22, wherein said engine and said oil filter are aligned with an opening of said deck.

24. The personal watercraft according to claim 22, wherein a mounting portion for mounting said oil filter is provided on an upper portion of said oil tank, and an oil receiving portion is formed in said mounting portion, said oil receiving portion being in communication with said communication passage.

25. The system for lubricating an engine for a personal watercraft according to claim 1, wherein said tank main body covers drive chambers for accessories of the engine including at least one of an AC generator, a balancer shaft, and a starter motor.

26. The personal watercraft according to claim 13, wherein said tank main body covers drive chambers for accessories of said engine including at least one of an AC generator, a balancer shaft, and a starter motor.

27. The system for lubricating an engine for a personal watercraft according to claim 1, wherein said oil pump is accommodated in a tank main body side portion of said oil tank, and suction/discharge passages of said oil pump are formed by said tank main body.

28. The personal watercraft according to claim 13, wherein said oil pump is accommodated in a tank main body side portion of said oil tank, and suction/discharge passages of said oil pump are formed by said tank main body.

* * * * *